US010280687B1

(12) United States Patent
Mukhopadhyay et al.

(10) Patent No.: US 10,280,687 B1
(45) **Date of Patent: *May 7, 2019**

(54) POLYCRYSTALLINE DIAMOND COMPACTS INCLUDING INFILTRATED POLYCRYSTALLINE DIAMOND TABLE AND METHODS OF MAKING SAME

(71) Applicant: US SYNTHETIC CORPORATION, Orem, UT (US)

(72) Inventors: Debkumar Mukhopadhyay, Sandy, UT (US); Brandon Paul Linford, Draper, UT (US); Jed Clarke, Springville, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 494 days.

This patent is subject to a terminal disclaimer.

(21) Appl. No.: 14/313,715

(22) Filed: Jun. 24, 2014

Related U.S. Application Data

(63) Continuation-in-part of application No. 13/795,027, filed on Mar. 12, 2013.

(51) Int. Cl.
*B24D 3/10* (2006.01)
*B24D 18/00* (2006.01)
(Continued)

(52) U.S. Cl.
CPC ..... *E21B 10/567* (2013.01); *B24D 3/10* (2013.01); *B24D 18/0009* (2013.01); *E21B 10/55* (2013.01)

(58) Field of Classification Search
None
See application file for complete search history.

(56) References Cited

U.S. PATENT DOCUMENTS 3,149,411 A 9/1964 Smiley et al.
3,293,012 A 12/1966 Smiley et al.
(Continued)

FOREIGN PATENT DOCUMENTS

WO WO 2012/009285 1/2012

OTHER PUBLICATIONS

U.S. Appl. No. 12/961,787, filed Dec. 7, 2010, Mukhopadhyay et al.
(Continued)

*Primary Examiner* — Kaj K Olsen
*Assistant Examiner* — Ross J Christie
(74) *Attorney, Agent, or Firm* — Dorsey & Whitney LLP

(57) ABSTRACT

Embodiments relate to polycrystalline diamond compacts and methods of manufacturing such compacts in which an at least partially leached polycrystalline diamond ("PCD") table is infiltrated with first and second infiltrants. The first infiltrant includes a low viscosity cobalt-based and/or nickel-based alloy infiltrant. The second infiltrant (e.g., copper) is specifically selected to be more easily infiltrated and/or removed (e.g., leached) than a pure cobalt infiltrant. In an embodiment, a method includes forming a PCD table in the presence of a metal-solvent catalyst in a first high-pressure/high-temperature ("HPHT") process. The PCD table may be at least partially leached to remove at least a portion of the metal-solvent catalyst therefrom. The leached PCD table and a substrate are subjected to a second HPHT process effective to bond the substrate to the leached PCD table while at least partially infiltrating the PCD table with at least the first and second infiltrants.

16 Claims, 15 Drawing Sheets

(51) Int. Cl.
*E21B 10/55* (2006.01)
*E21B 10/567* (2006.01)

(56) References Cited

U.S. PATENT DOCUMENTS 3,372,010 A 3/1968 Parsons
4,018,576 A 4/1977 Lowder et al.
4,124,401 A * 11/1978 Lee ..... B01J 3/062 51/307
4,168,957 A * 9/1979 Lee ..... C04B 35/6455 51/307
4,171,339 A 10/1979 Lee
4,268,276 A 5/1981 Bovenkerk
4,274,900 A 6/1981 Mueller
4,410,054 A 10/1983 Nagel et al.
4,468,138 A 8/1984 Nagel
4,534,773 A 8/1985 Phaal et al.
4,560,014 A 12/1985 Geczy
4,738,322 A 4/1988 Hall et al.
4,811,801 A 3/1989 Salesky et al.
4,871,377 A 10/1989 Frushour
4,907,377 A 3/1990 Csillag et al.
4,913,247 A 4/1990 Jones
4,943,488 A 7/1990 Sung et al.
5,016,718 A 5/1991 Tandberg
5,030,276 A 7/1991 Sung et al.
5,092,687 A 3/1992 Hall
5,120,327 A 6/1992 Dennis
5,135,061 A 8/1992 Newton, Jr.
5,154,245 A 10/1992 Waldenstrom et al.
5,364,192 A 11/1994 Damm et al.
5,368,398 A 11/1994 Damm et al.
5,460,233 A 10/1995 Meany et al.
5,480,233 A 1/1996 Cunningham
5,544,713 A 8/1996 Dennis
5,711,702 A 1/1998 Devlin
5,871,060 A 2/1999 Jensen et al.
6,003,623 A 12/1999 Miess
6,488,106 B1 12/2002 Dourfaye
6,793,681 B1 9/2004 Pope et al.
7,377,341 B2 5/2008 Middlemiss et al.
7,552,782 B1 6/2009 Sexton et al.
7,559,695 B2 7/2009 Sexton et al.
7,828,088 B2 11/2010 Middlemiss et al.
7,866,418 B2 1/2011 Bertagnolli et al.
8,066,087 B2 11/2011 Griffo et al.
8,328,891 B2 12/2012 Zhang et al.
8,596,387 B1 12/2013 Sani et al.
8,727,045 B1 5/2014 Mukhopadhyay
9,027,675 B1 * 5/2015 Jones ..... E21B 10/46 175/425
9,272,392 B2 3/2016 Mukhopadhyay et al.
9,297,212 B1 3/2016 Castillo et al.
2005/0211475 A1 * 9/2005 Mirchandani ..... C22C 29/00 175/426
2005/0230156 A1 10/2005 Belnap et al.
2006/0157285 A1 7/2006 Cannon et al.
2006/0266558 A1 11/2006 Middlemiss et al.
2007/0079994 A1 4/2007 Middlemiss
2008/0230279 A1 9/2008 Bitler et al.
2008/0230280 A1 9/2008 Keshavan et al.
2009/0152018 A1 6/2009 Sani
2010/0012389 A1 1/2010 Zhang
2010/0193252 A1 8/2010 Mirchandani et al.
2010/0198353 A1 8/2010 Pope et al.
2010/0281782 A1 * 11/2010 Keshavan ..... C04B 35/52 51/295
2010/0326740 A1 12/2010 Hall et al.
2011/0023375 A1 * 2/2011 Sani ..... B22F 3/24 51/297
2011/0067929 A1 3/2011 Mukhopadhyay et al.
2011/0132667 A1 6/2011 Smallman et al.
2012/0012402 A1 * 1/2012 Thigpen ..... C22C 26/00 51/307
2012/0040183 A1 2/2012 Kelkar
2012/0138370 A1 6/2012 Mukhopadhyay
2012/0261197 A1 10/2012 Miess et al.
2013/0022836 A1 1/2013 Easley et al.
2013/0092451 A1 * 4/2013 Mukhopadhyay ..... B01J 3/062 51/295
2013/0092452 A1 * 4/2013 Mukhopadhyay ..... B22F 7/062 51/295
2014/0259962 A1 * 9/2014 Bao ..... B24D 18/0009 51/308
2015/0292270 A1 * 10/2015 Zhang ..... C22C 26/00 51/297
2016/0136785 A1 5/2016 Mukhopadhyay et al.

OTHER PUBLICATIONS

U.S. Appl. No. 13/027,954, filed Feb. 15, 2011, Miess et al.
U.S. Appl. No. 13/087,775, filed Apr. 15, 2011, Miess et al.
U.S. Appl. No. 13/690,397, filed Nov. 30, 2012, Miess et al.
U.S. Appl. No. 61/768,812, filed Feb. 25, 2013, Mukhopadhyay.
U.S. Appl. No. 13/795,027, filed Mar. 12, 2013, Mukhopadhyay et al.
U.S. Appl. No. 13/863,465, filed Apr. 16, 2013, Castillo, et al.
ASTM B887-03 (2008) "Standard Test Method for Determination of Coercivity (Hcs) of Cemented Carbides".
ASTM B886-03 (2008), "Standard Test Method for Determination of Magnetic Saturation (Ms) of Cemented Carbides".
U.S. Appl. No. 13/954,545, filed Jul. 30, 2013, Mukhopadhyay.
U.S. Appl. No. 14/539,015, filed Nov. 12, 2014, Mukhopadhyay et al.
U.S. Appl. No. 62/096,315, filed Dec. 23, 2014, Heaton et al.
U.S. Appl. No. 62/187,574, filed Jul. 1, 2015, Heaton.
U.S. Appl. No. 14/857,627, filed Sep. 17, 2015, Mukhopadhyay et al.
Hildebrand et al., "Viscosity of liquid metals: An interpretation"; Proc. Nat. Acad. Sci. USA, vol. 73, No. 4, pp. 988-989, Apr. 1976.
International Search Report and Written Opinion from International Application No. PCT/US2012/059706 dated Apr. 19, 2013.
U.S. Appl. No. 13/863,465, Jul. 28, 2015, Office Action.
U.S. Appl. No. 13/863,465, Oct. 23, 2015, Interview Summary.
U.S. Appl. No. 13/863,465, Nov. 17, 2015, Notice of Allowance.
U.S. Appl. No. 13/275,372, Aug. 22, 2014, Office Action.
U.S. Appl. No. 13/275,372, Jan. 28, 2015, Office Action.
U.S. Appl. No. 13/275,372, Apr. 14, 2015, Office Action.
U.S. Appl. No. 13/275,372, Jun. 24, 2015, Notice of Allowance.
U.S. Appl. No. 13/275,372, Oct. 23, 2015, Notice of Allowance.
U.S. Appl. No. 13/648,913, Jun. 25, 2015, Office Action.
U.S. Appl. No. 13/648,913, Dec. 4, 2015, Office Action.
U.S. Appl. No. 15/050,105, filed Feb. 22, 2016, Castillo et al.
U.S. Appl. No. 13/863,465, Mar. 9, 2016, Issue Notification.
U.S. Appl. No. 13/275,372, Feb. 10, 2016, Issue Notification.
U.S. Appl. No. 13/648,913, Jul. 8, 2016, Notice of Allowance.
U.S. Appl. No. 13/648,913, Oct. 19, 2016, Issue Notification.
U.S. Appl. No. 14/857,627, Feb. 18, 2016, Office Action.
U.S. Appl. No. 14/857,627, Sep. 6, 2016, Notice of Allowance.
U.S. Appl. No. 15/372,766, filed Dec. 8, 2016, Mukhopadhyay, et al.
U.S. Appl. No. 14/857,627, Dec. 21, 2016, Issue Notification.
U.S. Appl. No. 15/050,105, Aug. 7, 2017, Office Action.
U.S. Appl. No. 13/795,027, Nov. 2, 2017, Restriction Requirement.
U.S. Appl. No. 15/050,105, Dec. 4, 2017, Notice of Allowance.
U.S. Appl. No. 15/050,105, Mar. 21, 2018, Issue Notification.
U.S. Appl. No. 13/795,027, Jun. 7, 2018, Office Action.
U.S. Appl. No. 15/005,765, May 15, 2018, Office Action.

* cited by examiner

POLYCRYSTALLINE DIAMOND COMPACTS INCLUDING INFILTRATED POLYCRYSTALLINE DIAMOND TABLE AND METHODS OF MAKING SAME

CROSS-REFERENCE TO RELATED APPLICATIONS

This application is a continuation-in-part of U.S. application Ser. No. 13/795,027 filed on 12 Mar. 2013, the disclosure of which is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container or cartridge with a volume of diamond particles positioned on a surface of the cemented carbide substrate. A number of such cartridges may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. Cobalt is often used as the catalyst material for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst. Once the PCD table is formed, the solvent catalyst may be at least partially removed from the PCD table of the PDC by acid leaching.

Despite the availability of a number of different PDCs, manufacturers and users of PDCs continue to seek PDCs that exhibit improved toughness, wear resistance, thermal stability, or combinations thereof.

SUMMARY

Embodiments of the invention relate to PDCs and methods of manufacturing such PDCs in which a PCD table (e.g., preformed and at least partially leached PCD table) is infiltrated with a first infiltrant comprising an alloy infiltrant including a cobalt-based alloy infiltrant, a nickel-based alloy infiltrant, or combinations thereof. The first infiltrant has a lower liquidus temperature than a melting point of a respective one of a pure cobalt or pure nickel infiltrant. By decreasing the liquidus temperature of the alloy infiltrant, a viscosity of the alloy infiltrant may be lower as compared to a viscosity of pure cobalt or pure nickel at any given processing temperature and pressure. The lower viscosity may promote more uniform infiltration into the at least partially leached PCD table. In addition to infiltration with the first infiltrant, the PCD table is also infiltrated with a second infiltrant that may have a melting temperature or liquidus temperature at standard pressure of less than about 1300° C. The second infiltrant may be more readily removed (e.g., leached) from the PCD table than a pure cobalt or pure nickel infiltrant. The second infiltrant may also improve the thermal stability and/or wear resistance of a PCD table containing at least a portion of the second infiltrant.

In an embodiment, a method of fabricating a PDC is disclosed. The method includes forming a PCD table in the presence of a metal-solvent catalyst in a first HPHT process. The PCD table includes a plurality of bonded diamond grains defining a plurality of interstitial regions, with at least a portion of the plurality of interstitial regions including the metal-solvent catalyst disposed therein. The method further includes at least partially leaching the PCD table to remove at least a portion of the metal-solvent catalyst therefrom to form an at least partially leached PCD table. The method additionally includes subjecting the at least partially leached PCD table and a substrate to a second HPHT process under diamond-stable temperature-pressure conditions effective to at least partially infiltrate the at least partially leached PCD table with a first infiltrant comprising a cobalt-based alloy infiltrant (e.g., a cobalt-silicon alloy), a nickel-based alloy infiltrant (e.g., a nickel-silicon alloy), or combinations thereof. The first infiltrant may have a composition exhibiting a liquidus temperature that is lower than a melting point of a respective one of a pure cobalt or pure nickel infiltrant. The at least partially leached PCD table is also infiltrated with a second infiltrant (e.g., during the second HPHT process or another process), which may be more readily removed (e.g., leached) from the infiltrated PCD table than a pure cobalt or pure nickel infiltrant. Depending on the process conditions, the first and second infiltrants form an alloy that is interstitially disposed within the infiltrated polycrystalline diamond table.

In an embodiment, a PDC includes a cemented carbide substrate and a preformed PCD table including a plurality of bonded diamond grains defining a plurality of interstitial regions. The preformed PCD table includes a back surface bonded to the cemented carbide substrate and an upper working surface. An infiltrant may be disposed in at least a portion of the plurality of interstitial regions. The infiltrant includes an alloy comprising at least one of nickel or cobalt; and at least one of carbon, silicon, boron, phosphorus, cerium, tantalum, titanium, niobium, molybdenum, antimony, tin, or carbides thereof.

Other embodiments include applications employing the disclosed PDCs in various articles and apparatuses, such as rotary drill bits, bearing apparatuses, machining equipment, and other articles and apparatuses. Other embodiments include methods of fabricating such articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Figure 1A:
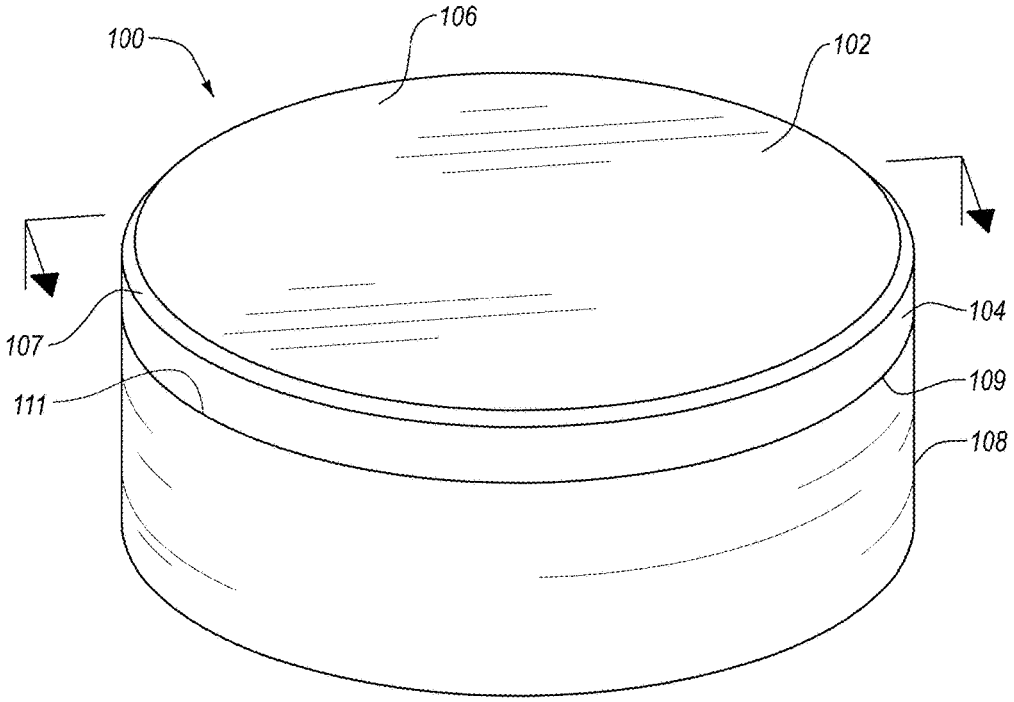
FIG. 1A is an isometric view of an embodiment of a PDC.

Embodiments of the invention relate to PDCs and methods of manufacturing such PDCs. Generally, embodiments relate to methods of forming an at least partially leached PCD table and bonding the at least partially leached PCD table to a substrate with a first infiltrant that is an alloy exhibiting a selected viscosity. The at least partially leached PCD table is also infiltrated with a second infiltrant that is composed to be readily removed (e.g., leached) from the at least partially leached PCD table after infiltration thereof, or alternatively left in the PCD table to improve wear resistance and/or thermal stability. For example, such methods may enable relatively substantially complete infiltration of the at least partially leached PCD table when attaching the PCD table to a substrate, followed by relatively easy removal of one or more infiltrants disposed interstitially adjacent to a working surface of the infiltrated PCD table.

More specifically, an at least partially leached PCD table (i.e., a porous, pre-sintered PCD table) may be provided. The at least partially leached PCD table may be fabricated by subjecting a plurality of diamond particles (e.g., diamond particles having an average particle size between 0.5 μm to about 150 μm) to an HPHT sintering process in the presence of a catalyst, such as cobalt, nickel, iron, or an alloy of any of the preceding metals to facilitate intergrowth between the diamond particles and form a PCD table comprising bonded diamond grains defining interstitial regions having the catalyst disposed within at least a portion of the interstitial regions. The as-sintered PCD table may be reached by immersion in an acid or subjected to another suitable process to remove at least a portion of the catalyst from the interstitial regions of the PCD table and form the at least partially leached PCD table. The at least partially leached PCD table includes a plurality of interstitial regions that were previously occupied by a catalyst and form a network of at least partially interconnected pores. In an embodiment, the sintered diamond grains of the at least partially leached PCD table may exhibit an average grain size of about 100 μm or less, such as about 40 μm or less, about 30 μm or less, about 25 μm or less, about 20 μm or less, about 10 μm to about 18 μm, about 8 μm to about 15 μm, about 9 μm to about 12 μm, about 16 μm to about 20 μm, about 26 μm to about 30 μm, about 15 μm to about 25 μm, about 10 μm or less, or about 2 μm to about 5 μm or submicron.

Subsequent to leaching the PCD table, the at least partially leached PCD table may be bonded to a substrate in an HPHT process via a first infiltrant with a selected viscosity. For example, a first infiltrant may be selected that exhibits a viscosity that is less than a viscosity typically exhibited by a cobalt and/or nickel cementing constituent of typical cobalt-cemented and/or nickel-cemented tungsten carbide substrates.

Such a first infiltrant having a reduced viscosity may result in an effective and/or sufficiently complete infiltration/bonding of the at least partially leached PCD table to the substrate during the HPHT process. The first infiltrant may comprise, for example, one or more metals or alloys of one or more metals. For example, an infiltrant exhibiting a selected viscosity may comprise cobalt, nickel, iron, molybdenum, copper, silver, gold, titanium, vanadium, chromium, manganese, niobium, technetium, hafnium, tantalum, tungsten, rhenium, ruthenium, rhodium, palladium, osmium, iridium, platinum, silicon, alloys thereof, mixtures thereof, or combinations thereof, without limitation. Such a first infiltrant may be present within a cemented carbide substrate or may be formed with another material during an HPHT process for bonding a PCD table to the cemented carbide substrate.

In some embodiments, a viscosity of a first infiltrant that is an alloy infiltrant (e.g., cobalt, nickel, iron, or alloys thereof) may be decreased by alloying with at least one eutectic forming alloying constituent. In an embodiment, the eutectic forming alloying constituent may be present in an amount at or near a eutectic composition for the alloy—at least one eutectic forming alloying constituent system. As used herein, "a cobalt-based alloy" may refer to a cobalt alloy having at least 50% by weight cobalt. As used herein, "a nickel-based alloy" may refer to a nickel alloy having at least 50% by weight nickel. A PCD table can exhibit relatively low porosity, which can make it difficult for an infiltrant from a substrate or other source to effectively infiltrate and penetrate into the PCD table for bonding the PCD table to a substrate. Insufficient penetration may occur when a preformed PCD table is to be bonded to a carbide substrate, and the preformed PCD table was formed under exceptionally high pressure conditions (e.g., at least about 7.5 GPa cell pressure). Insufficient penetration may also occur when a preformed PCD table was formed under standard pressure conditions (e.g., between about 5.0 and about 6.0 GPa cell pressure or about 7.5 GPa or less, or about 6 GPa or less, causing larger porosity than PCD tables formed at greater cell pressures), but the interstitial regions therein have not been thoroughly leached of the metal-solvent catalyst therein used in the formation thereof. For instance, a thorough leaching process may result a PCD table having only about 1.0% by weight of cobalt or less in the interstitial regions thereof, whereas a less thorough leaching process may result in a PCD table having more than about 1.0% by weight of cobalt in the interstitial regions thereof, such as about 1.2% cobalt or more. Theoretically, among other variables, depth of infiltration of the infiltrant is inversely proportional to the viscosity of the infiltrant. Attempting to attach a PCD table having extremely fine porosity, or partially filled interstitial spaces due to incomplete leaching, to a substrate using pure cobalt or pure nickel can result in insufficient depth of penetration, which can later lead to delamination of the PCD table from the substrate and/or chipping of the PCD table during use. It is currently believed that PCD tables formed under HPHT conditions, including a relatively lower or moderate cell pressure (i.e., about 5 to 6 GPa), can experience delamination when the metal-solvent catalyst is not thoroughly leached from within the interstitial regions thereof (e.g., in PCD tables exhibiting about 1.2% by weight of cobalt or more in the interstitial regions thereof). Increasing the processing temperature at which attachment occurs (which would decrease the viscosity of the cobalt or nickel) can result in damage (e.g., increased back conversion of the diamond) to the preformed PCD table. Increasing the processing temperature at which attachment occurs (which would also decrease the viscosity of a second infiltrant) can result in poor infiltration of the first infiltrant and thereby poor bonding, due to the second infiltrant having lower melting temperature than the first infiltrant, resulting in infiltration of the PCD table by the second infiltrant before the first infiltrant melts, thereby inhibiting infiltration of the first infiltrant. A first infiltrant comprising a low viscosity alloy (e.g., silicon containing material) may improve the infiltration of the first infiltrant under similar conditions. Low viscosity alloys may melt at lower temperatures than pure elemental infiltrants (e.g., a cobalt-silicon alloy versus pure cobalt) and/or move more readily through the interstitial pore spaces in a PCD table thereby infiltrating the PCD table more thoroughly than materials with a higher viscosity.

Once the preformed PCD table has been metallurgically bonded to the substrate, it is often desirable to leach at least a portion of the PCD table (e.g., adjacent a working surface of the PCD table). Removal of the interstitially present infiltrant can be difficult, and so it is desirable to infiltrate the PCD table with a second infiltrant (e.g., substantially simultaneous with infiltration of the first infiltrant) in order to facilitate easier removal (e.g., by leaching) of one or more of the infiltrants from interstitial regions from at least a portion of the PCD table. Thus, in addition to infiltration with the first infiltrant, which may comprise a cobalt alloy, a nickel alloy, or combinations thereof in order to metallurgically bond the preformed PCD table to a substrate, the PCD table is also infiltrated with a second infiltrant that is more readily leached or otherwise removed from the PCD table than a cobalt or nickel infiltrant. Use of the second infiltrant may result in an alloy interstitially present within interstitial regions between adjacent diamond grains of the PCD table, which alloy (an alloy of both the first and second infiltrants) is more readily removed than a nickel infiltrant, a cobalt infiltrant, a cobalt-alloy infiltrant (e.g., where only the first infiltrant were employed, and where the first infiltrant were a cobalt-alloy), or a nickel-alloy infiltrant (e.g., where only the first infiltrant were employed, and where the first infiltrant were a nickel-alloy). It may also be desirable to infiltrate the portion of the PCD table nearest the working surface with a material that will improve wear resistance and/or thermal stability of the PCD table. For example, an infiltrant (e.g., copper-containing material) occupying the interstitial regions of a PCD table nearest the working surface that is more thermally stable than or does less damage to the PCD table at elevated temperatures than the second infiltrant may improve the thermal stability and/or wear resistance of the PCD table.

In an embodiment, the second infiltrant may melt and infiltrate into the PCD table before the first infiltrant melts, thereby infiltrating (i.e., at least partially filling) the interstitial spaces of the PCD table, inhibiting the first infiltrant from penetrating into the PCD table as thoroughly as if a second infiltrant were present. For example, a 0.005 inch second infiltrant disc may be placed on top of the PCD table nearest the working surface. Under HPHT conditions for attaching a PCD table to a substrate, the first infiltrant comprising, for example, copper, will melt at about 1085° C., whereas a first infiltrant comprising, for example, pure cobalt, may melt at a higher temperature such as about 1495° C. (or about 1300° C. for a WC—Co eutectic composition). In such an embodiment, the copper will melt before the cobalt and infiltrate the PCD table from the working surface to some depth within the table, such as substantially the entire table. In such an embodiment, the first infiltrant may not as readily infiltrate the PCD table due to competition with the second infiltrant, potentially causing deficient bonding between the PCD table and the substrate, which may result in at least one of delamination, cracking or spalling. In an embodiment, the first infiltrant may comprise a low viscosity alloy. For example, the first infiltrant may comprise a cobalt-silicon alloy, whereby alloying cobalt with silicon lowers the viscosity and liquidus temperature of cobalt. In an embodiment, a substrate may include about 13.5% by weight cobalt, about 0.5% by weight of silicon, and about 86% by weight of tungsten carbide. The addition of silicon may lower the liquidus or melting temperature of cobalt to lower than about 1450° C., lower than about 1400° C., or lower than about 1350° C., depending on the amount of eutectic forming alloying constituent used. Lower viscosity and melting temperature may allow the first infiltrant to more readily and thoroughly penetrate into the PCD table despite difficulties such as small sizes in and between the interstitial spaces and other infiltrants present in the PCD table blocking or inhibiting infiltration.

As described in more detail below, the resultant alloy formed from the first and second infiltrants may comprise at least one of nickel or cobalt; at least one of carbon, silicon, boron, phosphorus, cerium, tantalum, titanium, niobium, molybdenum, antimony, tin, or carbides thereof; and at least one of magnesium, lithium, tin, silver, copper, nickel, zinc, germanium, gallium, antimony, bismuth, or gadolinium. Furthermore, such a composition of such an alloy may continuously vary throughout the thickness of the PCD table depending on how the first and second infiltrants are provided. The extent of alloying between the first and second infiltrants (if any) may depend on the HPHT conditions employed during the infiltration process.

Figure 1B:
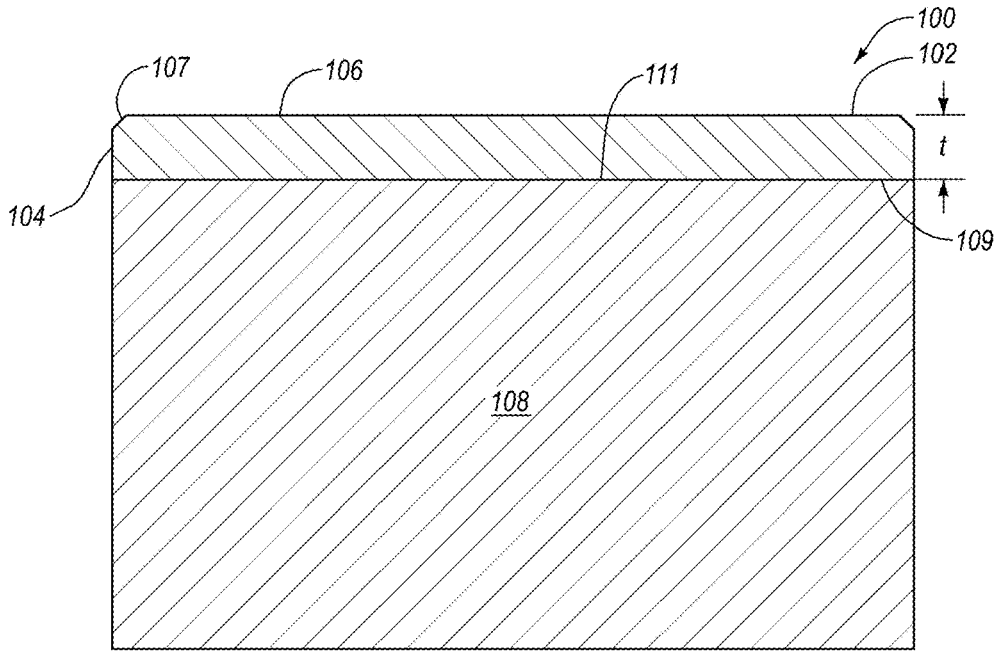
FIG. 1B is a cross-sectional view of a PDC of FIG. 1A.

FIGS. 1A and 1B are isometric and cross-sectional views, respectively, of an embodiment of a PDC 100 including a preformed PCD table 102 attached to a cemented carbide substrate 108 along an interfacial surface 109 thereof. The PCD table 102 includes a plurality of directly bonded-together diamond grains exhibiting diamond-to-diamond bonding (e.g., $sp^3$ bonding) therebetween, which define a plurality of interstitial regions.

The PCD table 102 includes at least one lateral surface 104, an upper exterior working surface 106, an optional chamfer 107 extending therebetween, and a back surface 111 generally opposite the working surface 106. It is noted that at least a portion of the at least one lateral surface 104 and/or the chamfer 107 may also function as a working surface that contacts a subterranean formation during drilling operations. Additionally, although the interfacial surface 109 is illustrated as being substantially planar, in other embodiments, the interfacial surface 109 may exhibit a selected nonplanar topography. In such embodiments, the back surface 111 of the PCD table 102 may also exhibit a correspondingly configured nonplanar interfacing topography.

The bonded-together diamond grains of the PCD table may exhibit an average grain size of about 100 μm or less, about 40 μm or less, such as about 30 μm or less, about 25 μm or less, or about 20 μm or less. For example, the average grain size of the diamond grains may be about 10 μm to about 18 μm, about 8 μm to about 15 μm, about 9 μm to about 12 μm, about 16 μm to about 20 μm, about 26 μm to about 30 μm, or about 15 μm to about 25 μm. In some embodiments, the average grain size of the diamond grains may be about 10 μm or less, such as about 2 μm to about 5 μm or submicron.

In an embodiment, the first infiltrant (e.g., a cobalt-based alloy infiltrant and/or nickel-based alloy infiltrant) provided from the cemented carbide substrate 108 or another source may be disposed within at least some of the interstitial regions of a first region of the PDC table 102 adjacent to the cemented carbide substrate 108 (e.g., a region extending inwardly from the interfacial surface 109 to an intermediate depth), and the second infiltrant (e.g., copper) may be disposed within at least some of the interstitial regions of a second region of the PDC table 102 remote from the cemented carbide substrate 108 (e.g., a region extending inwardly from the exterior working surface 106 to an intermediate depth). In an embodiment the first and second infiltrants may both infiltrate the PCD table 102 but remain separate within the PCD table 102 (e.g., remain in discrete regions that do not overlap). In an embodiment, the first and second infiltrants may form an alloy, which may have a composition that varies throughout a thickness of the preformed PCD table 102. For example, the resultant alloy formed from the first and second infiltrants may comprise at least one of nickel or cobalt; at least one of carbon, silicon, boron, phosphorus, cerium, tantalum, titanium, niobium, molybdenum, antimony, tin, or carbides thereof; and at least one of magnesium, lithium, tin, silver, copper, nickel, zinc, germanium, gallium, antimony, bismuth, or gadolinium. It should be noted that depending on the amount of the first and second infiltrants and the geometry of the PCD table 102, a third infiltrant from the cemented carbide substrate portion 108 (e.g., cobalt from a cobalt-cemented tungsten carbide substrate) may also infiltrate into the PCD table 102 following the first and second infiltrants and occupy a region of the PCD table 102 adjacent to the cemented carbide substrate 108. In embodiments, the first infiltrant may be provided directly from the substrate 108 (e.g., a cobalt-silicon alloy from a cobalt-cemented tungsten carbide substrate). It should be noted that as the interfacial surface 109 is bonded to the back surface 111 in the PCD tables described herein, descriptions of first infiltrant being infiltrated from the interfacial surface inward and the first region extending from the interfacial surface inward, may alternatively be described as, the first infiltrant being infiltrated from the back surface inward and the first region extending from the back surface inward.

As will be discussed in more detail below, the first infiltrant, which may be a cobalt-based alloy infiltrant and/or nickel-based alloy infiltrant may include cobalt and/or nickel and at least one eutectic forming alloying constituent. In an embodiment, the first infiltrant may have a composition at or near a eutectic composition for a system of cobalt and/or nickel and the at least one eutectic forming alloying constituent. As used herein, a composition that is "at or near a eutectic composition of the cobalt-based alloy" or "at or near the eutectic composition of the cobalt-based alloy" may include about 0.001 to 3 times (e.g., about 0.001 to about 0.3 times, about 0.4 to about 1.5 times, about 0.7 to about 1.2 times, or about 0.9 to about 1.1 times) the eutectic composition with respect to the eutectic forming alloying constituent. Another embodiment may include at least one eutectic forming alloying constituent in any amount greater than 0 and up to 2 times the eutectic composition. The lower limit of such a concentration range of the at least one eutectic forming alloying constituent may be greater than 0, about 0.001 times the eutectic composition, about 0.01 times the eutectic composition, or about 0.1 times the eutectic composition. Similarly, as used herein, a composition that is "at or near a eutectic composition of the nickel-based alloy" or "at or near the eutectic composition of the nickel-based alloy" may include about 0.001 to 3 times (e.g., about 0.001 to about 0.3 times, about 0.4 to about 1.5 times, about 0.7 to about 1.2 times, or about 0.9 to about 1.1 times) the eutectic composition with respect to the eutectic forming alloying constituent. Another nickel-based alloy embodiment may include at least one eutectic forming alloying constituent in any amount greater than 0 and up to 2 times the eutectic composition. The lower limit of such a concentration range of the at least one eutectic forming alloying constituent may be greater than 0, about 0.001 times the eutectic composition, about 0.01 times the eutectic composition, or about 0.1 times the eutectic composition. Thus, the alloy first infiltrant having a composition that is at or near a eutectic composition, may be at a eutectic composition, may be hypo-eutectic, or may be hyper-eutectic, over a wide range of compositions, so long as the resulting alloy first infiltrant has a liquidus temperature that is lower than a melting point of a respective one of a pure cobalt or pure nickel infiltrant.

Referring to the cross-sectional view of the PDC 100 shown in FIG. 1B, the PCD table 102 may exhibit a thickness "t" of at least about 0.040 inch, such as about 0.045 inch to about 0.150 inch, about 0.050 inch to about 0.120 inch, about 0.065 inch to about 0.100 inch, about 0.050 inch to about 0.3 inch, about 0.090 inch to about 0.120 inch, or about 0.070 inch to about 0.090 inch.

Figure 1C:
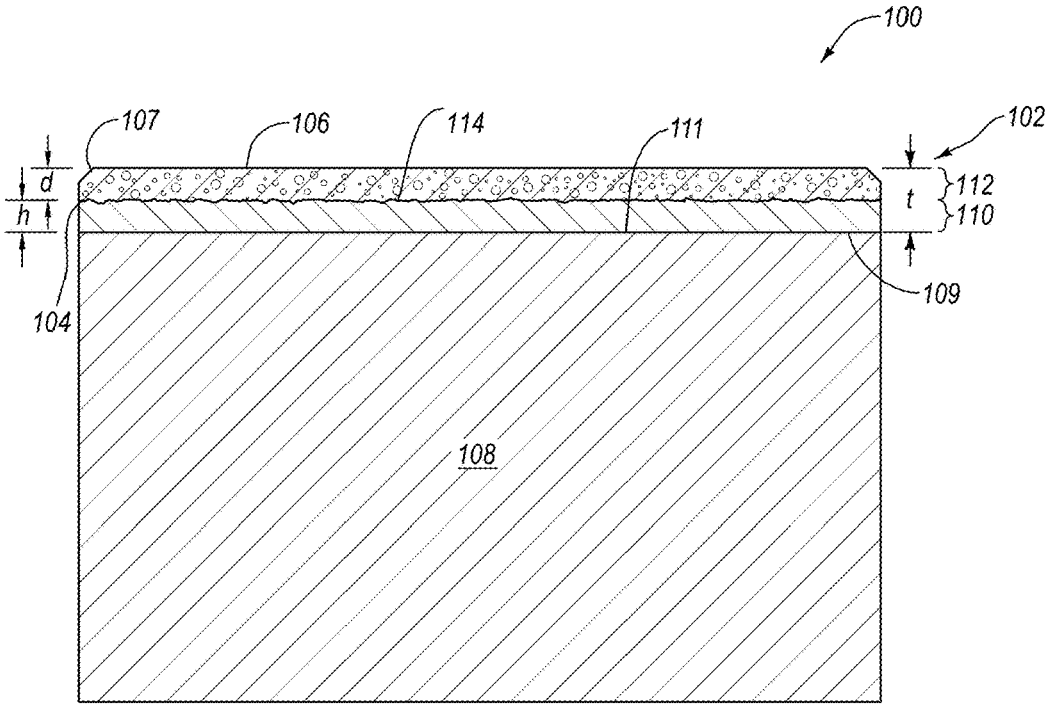
FIG. 1C is a cross-sectional view of a PDC similar to that of FIG. 1A in which the PCD table is only partially infiltrated from below according to an embodiment.

Referring to FIG. 1C, according to another embodiment, the PCD table 102 may include a first region 110 adjacent to the cemented carbide substrate 108 that extends from the interfacial surface 109 an average selected infiltration distance "h" and includes the first infiltrant, the second infiltrant, both the first and second infiltrants, an alloy of the first and second infiltrant, or combinations thereof disposed in at least a portion of the interstitial regions thereof. The PCD table 102 may include a second region 112 that extends inwardly from the working surface 106 to an average selected depth "d." The depth "d" may be at least about 200 μm, at least about 500 μm, about 200 μm to about 600 μm, about 500 μm to about 2100 μm, about 750 μm to about 2100 μm, about 950 μm to about 1500 μm, about 1000 μm to about 1750 μm, about 1000 μm to about 2000 μm, about 1500 μm to about 2000 μm, at least about a quarter of the thickness of the PCD table 102, about a third of the thickness of the PCD table 102, about half of the thickness of the PCD table 102, at least about more than half of the thickness of the PCD table 102, or about three quarters of the thickness of the PCD table 102. The interstitial regions of the second region 112 may be substantially free of the first and second infiltrants and/or any alloy of the first and second infiltrants. Such a two-region configuration for the PCD table 102 may be formed when bonding the PCD table 102 to the cemented carbide substrate 108 in a second, subsequent HPHT process by limiting infiltration of the infiltrants so that infiltration only extends part way through the depth of the PCD table 102.

As explained, such a configuration may be formed in a two-step process by providing an at least partially leached PCD table, and then attaching the at least partially leached PCD table to the cemented carbide substrate 108 in a subsequent HPHT process. The HPHT process parameters may be selected so that the first and second infiltrants (e.g., from the cemented carbide substrate 108 and/or other sources) sweep into the PCD table 102. Infiltration of the first and second infiltrants may only be partial, e.g., resulting in a configuration as shown in FIG. 1C. Where full infiltration is desired, the resulting configuration may be as shown in FIG. 1B.

Figure 1D:
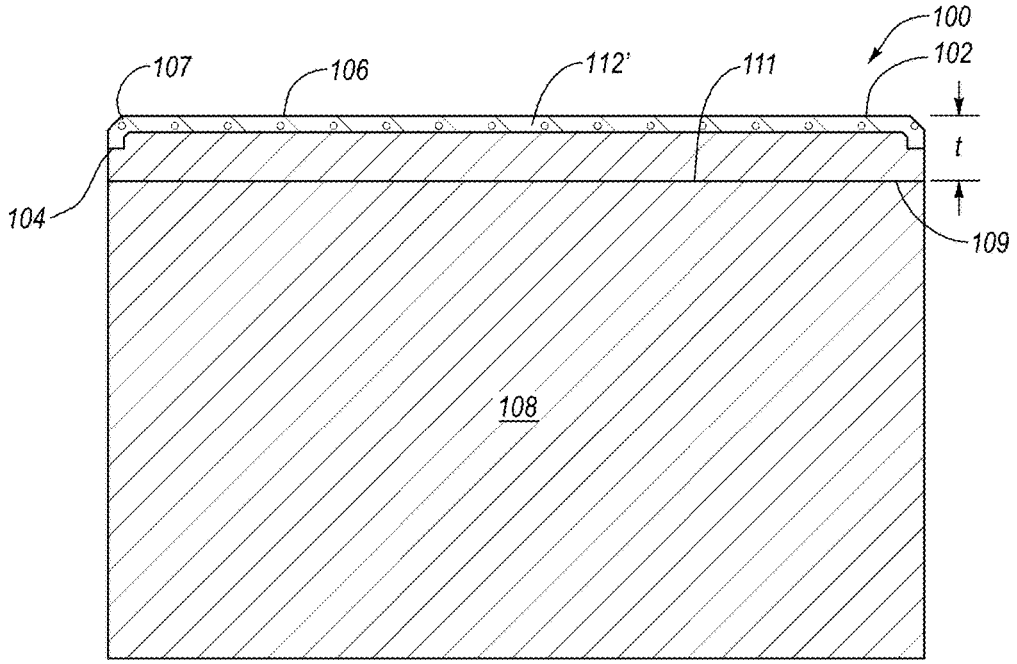
FIG. 1D is a cross-sectional view of the PDC of FIG. 1A in which the PCD table leached to a selected depth.

Referring to FIG. 1D, leaching the PCD table 102 shown in FIG. 1B may also be used to remove first and/or second infiltrants and/or alloys thereof to form a leached region 112' that generally contours the at least one lateral surface 104, upper exterior working surface 106, and chamfer 107 to a selected depth from any of the at least one lateral surface 104, upper exterior working surface 106, or chamfer 107. For example, when the PCD table 102 is fully or substantially infiltrated up to the working surface 106, the PCD table 102 may be selectively leached to form the leached region 112'. For example, the selected depth may be about 10 μm to about 1000 μm, such as about 10 μm to about 500 μm, about 20 μm to about 150 μm, about 30 μm to about 90 μm, about 20 μm to about 75 μm, about 200 μm to about 300 μm, or about 250 μm to about 500 μm. The selected depth may be about the entire thickness of the PCD table 102, about three quarters (¾) of the thickness of the PCD table 102, about two thirds (⅔) of the thickness of the PCD table 102, about one half (½) of the thickness of the PCD table 102, about one third (⅓) of the thickness of the PCD table 102, or about one quarter (¼) of the thickness of the PCD table 102. The leaching may be accomplished with a suitable acid, such as aqua regia, nitric acid, hydrofluoric acid, or mixtures thereof.

As the PCD table 102 may be fabricated from an at least partially leached PCD table that was subsequently at least partially infiltrated with the first infiltrant (e.g., a cobalt-based alloy infiltrant and/or nickel-based alloy infiltrant) and a second infiltrant (e.g., copper, tin, silicon, aluminum, magnesium, zinc, boron, silver, germanium, gallium, or alloys of one or more of the foregoing metals), the second region 112 may still include some residual metal-solvent catalyst used to initially form the diamond-to-diamond bonds that was not removed in a first leaching process, some fraction of the first infiltrant, second infiltrant, or some combination thereof in the PCD table second region 112, even after leaching to remove the first and second infiltrants. For example, the residual metal-solvent catalyst and/or residual infiltrants in the interstitial regions of the second region 112 may be about 0.5% to about 2.2% by weight, such as about 0.7% to about 2% by weight, about 0.9% by weight, about 1% by weight, about 1.1% by weight, about 0.8% by weight, about 0.7% by weight, about 1.2% by weight, about 1.3% by weight, about 1.4% by weight, about 1.5% by weight, about 1.6% by weight, about 1.7% by weight, about 1.8% by weight, about 1.9% by weight, about 2.0% by weight, about 2.1% by weight, about 2.2% by weight, or about 0.9% to about 1% by weight. Thorough leaching procedures may remove all but about 1% by weight or less of the metal-solvent catalyst from a leached region in PCD table 102. Even with the residual amount of the metal-solvent catalyst and/or residual infiltrants in the second region 112, the interstitial regions of the second region 112 may still be considered to be substantially void of material. Any residual metal-solvent catalyst within second region 112 may be the same or different from the first infiltrant used to attach PCD table 102 to substrate 108. For example, in an embodiment, a residual metal-solvent catalyst present within second region 112 may be cobalt, while a first infiltrant comprising a cobalt-based alloy infiltrant and/or nickel-based alloy infiltrant may be interstitially present within first region 110.

The first infiltrant comprising the cobalt-based alloy infiltrant and/or nickel-based alloy infiltrant present in the interstitial regions of the PCD table 102 may be provided at least partially or substantially completely from the cementing constituent of the cemented carbide substrate 108, or provided from another source such as a metallic foil, powder, paste, powder mixture, or a disc or generally conical or cylindrical member that is inserted between the cemented carbide substrate 108 and the PCD table 102 when attaching the PCD table 102 to substrate 108.

The second infiltrant provided for at least one of faster/easier/more complete leaching, to improve wear resistance, or thermal stability of the PCD table 102 may be provided from a metallic foil, powder, paste, powder mixture, or other insert provided between the cemented carbide substrate 108 and the PCD table 102, or positioned above PDC table 102 during infiltration and attachment of the PCD table 102 to the substrate 108. Various non-limiting configurations are described below in conjunction with FIGS. 3A-3D.

The cemented carbide substrate 108 may include a plurality of tungsten carbide and/or other carbide grains (e.g., tantalum carbide, vanadium carbide, niobium carbide, chromium carbide, titanium carbide, or combinations thereof) cemented together with the first infiltrant, e.g., a cobalt-based alloy infiltrant alloyed with at least one eutectic forming alloying constituent (i.e., at least one constituent that is capable of forming a eutectic system with cobalt) and/or a nickel-based alloy infiltrant alloyed with at least one eutectic forming alloying constituent (i.e., at least one constituent that is capable of forming a eutectic system with nickel). For example, the cemented carbide substrate 108 may comprise about 10% to about 15% cobalt by weight, about 0.1% to about 3% boron and/or silicon by weight (e.g., about 1% to about 2% silicon and/or boron by weight), with the balance being tungsten carbide. In such embodiments, the first infiltrant may be provided by the cemented carbide substrate 108. In an embodiment, the at least one eutectic forming alloying constituent may be present in elemental form. In another embodiment, the at least one eutectic forming alloying constituent may be present as a compound (e.g., a carbide of a given at least one eutectic forming alloying constituent in elemental form). In some embodiments, the cemented carbide substrate 108 may include two or more different carbides (e.g., tungsten carbide and tantalum carbide).

In another embodiment, the cemented carbide substrate 108 may include a plurality of tungsten carbide and/or other carbide grains (e.g., tantalum carbide, vanadium carbide, niobium carbide, chromium carbide, titanium carbide, or combinations thereof) cemented together with a metallic cementing constituent such as cobalt, nickel, or combinations thereof. In such embodiments, the first infiltrant may not be provided by the cementing constituent of the substrate, but may be provided by another source (e.g., a metallic foil, powder, powder mixture, or other structure provided between the cemented carbide substrate 108 and the PCD table 102).

The at least one eutectic forming alloying constituent present in the cobalt-based and/or nickel-based alloy of the first infiltrant may be any suitable constituent that can form a eutectic composition with cobalt and/or nickel and may present in any amount sufficient to lower the melting temperature (and thus viscosity) of the resulting alloy infiltrant to a value that is lower than a melting temperature of a respective pure cobalt or nickel infiltrant. Examples of the at least one eutectic forming alloying constituent for cobalt-based alloy infiltrants include, but are not limited to, carbon, silicon, boron, phosphorus, tantalum, niobium, molybdenum, antimony, tin, titanium, carbides thereof (e.g., tantalum or titanium carbide), and combinations thereof. Examples for the at least one eutectic forming alloying constituent for nickel-based alloy infiltrants include, but are not limited to, carbon, silicon, boron, phosphorus, cerium, tantalum, niobium, molybdenum, antimony, tin, titanium, carbides thereof, and combinations thereof.

In an embodiment, the microstructure of the cobalt-based and/or nickel-based alloy first infiltrant may be characteristic of a eutectic system, such as exhibiting a multiphase lamellar microstructure of the two dominant phases. Of course, once infiltrated into the PCD table along with the second infiltrant, the composition and/or microstructure of the first and second infiltrants may no longer be distinct from one another, but may themselves form an alloy (e.g., an alloy of the first and second infiltrants) disposed interstitially between the bonded together diamond grains of the PCD table. In addition, some carbon from the diamond grains of the PCD table 102 may become incorporated into the alloy of the first and second infiltrants present in the PCD table 102. Similarly, other constituents from the cemented carbide substrate 108 (e.g., tungsten and/or tantalum carbide) may also become incorporated into the first and second infiltrants as a result of HPHT processing.

The amount of the at least one eutectic forming alloying constituent in solid solution with cobalt and/or nickel in a first infiltrant at room temperature may be far less than at or near the eutectic composition of the first infiltrant at room temperature because of the low solid solubility of the at least one eutectic forming alloying constituent in cobalt and/or nickel at room temperature. In such a scenario, the first infiltrant may include a cobalt and/or nickel solid solution phase and at least one additional phase including the at least one eutectic forming alloying constituent, such as a substantially pure elemental phase, an alloy phase with another chemical element, one or more types of carbides, one or more types of borides, one or more types of phosphides, another type of chemical compound, or combinations of the foregoing. However, the overall composition of the first infiltrant may still be at or near the eutectic composition, when desired. Of course, lower concentrations of the at least one eutectic forming alloying constituent (e.g., any value greater than 0) are also contemplated, even where the composition may be less than 0.1 times the eutectic concentration. In another embodiment, the at least one eutectic forming alloying constituent may be present in an amount effective to reduce the liquidus temperature at standard pressure to not more than 1500° C., not more than 1450° C., not more than about 1400° C., not more than about 1350° C., not more than about 1300° C., not more than about 1200° C., not more than about 1100° C., or not more than about 1000° C.

For example, the cemented carbide substrate 108 may include about 1% by weight silicon (about 7.1% by weight of a cobalt-based alloy first infiltrant cementing constituent), about 13% by weight cobalt, and about 86% by weight tungsten carbide. In an embodiment, the cemented carbide substrate 108 may include about 0.5% by weight silicon (i.e., about 3.5% by weight of a cobalt-based alloy first infiltrant cementing constituent), about 13.5% by weight cobalt, and about 86% by weight tungsten carbide. Differing weight fractions may be employed depending on the desired viscosity and/or melting temperature of the resulting alloy. For example, a cemented carbide substrate may include about 0.1% by weight silicon, about 0.3% by weight of silicon, about 0.5% by weight of silicon, about 1% by weight of silicon, or about 0.1% by weight to about 0.5% by weight of silicon, or about 0.5% by weight or less (about 3.5% by weight or less of a cobalt-based alloy first infiltrant cementing constituent). More silicon may be alloyed with cobalt to obtain a lower viscosity and/or melting temperature for the resulting alloy. Similar weight fractions may be employed when substituting nickel for cobalt. First, silicon, tungsten carbide, and cobalt and/or nickel particles may be milled together to form a mixture. The mixture so-formed may be sintered to form the cemented carbide substrate 108. However, the cobalt-based and/or nickel-based alloy first infiltrant that serves as a cementing constituent of the cemented carbide substrate 108 may not have about 7.1% by weight of silicon in solid solution with cobalt and/or nickel because some of the silicon of the cobalt-based or nickel-based alloy infiltrant may be in the form of a substantially pure silicon phase, a silicon alloy phase, a silicide, silicon carbide, or combinations thereof. However, when the cemented carbide substrate 108 is used as a source for the first infiltrant to infiltrate an at least partially leached PCD table in an HPHT process, the silicon that is not in solid solution with cobalt and/or nickel, if any, may dissolve in the liquefied first infiltrant during HPHT processing because the HPHT processing temperature is typically well above the melting temperature for the cobalt-silicon and/or nickel-silicon system. Additionally, the at least one eutectic forming alloying constituent may also decrease the viscosity and/or melting temperature of the first infiltrant. Depending on the desired viscosity and melting temperature of the first infiltrant, more or less of the eutectic forming alloying constituent may be used. By way of non-limiting example, a cobalt-silicon alloy cemented tungsten-carbide substrate may include about 0.01% by weight to about 1% by weight of silicon, about 0.2% by weight to about 0.7% by weight of silicon, about 0.3% by weight to about 0.6% by weight of silicon, less than about 0.6% by weight or more of silicon, specifically about 0.5% by weight of silicon.

Use of a first infiltrant comprising a cobalt-based and/or nickel-based alloy rather than cobalt and/or nickel alone reduces the liquidus temperature of the cobalt-based and/or nickel-based alloy first infiltrant as compared to cobalt and/or nickel alone. This lowers the melting point and viscosity of the cobalt-based and/or nickel-based alloy infiltrant, providing for improved infiltration of the cobalt-based and/or nickel-based alloy first infiltrant into the finely porous structure of the PCD table 102 during attachment of the cemented carbide substrate 108 to the PCD table 102. This reduction in the viscosity at the sintering temperature is particularly beneficial when used with the PCD table 102 exhibiting relatively low porosity (e.g., less than about 0.09 μm median pore diameter, less than about 0.05 μm median pore diameter, or about 0.01 μm to 0.09 μm median pore diameter as measured by mercury porosimetry) prior to infiltration as a result of being formed under exceptionally high pressure conditions or dense packing mixtures. This reduction in viscosity at the HPHT processing temperature is also particularly beneficial when used with a PCD table 102 formed at relatively lower diamond-stable cell pressures such as about 7.5 GPa or less or about 5.0 GPa to about 6.0 GPa, but having more residual metal-solvent catalyst disposed within the pores spaces thereof (e.g., having about 1.2% by weight or more of cobalt) than a thoroughly leached PCD table (i.e., having about 1.0% by weight or less of cobalt). As a practical matter, full infiltration may reduce a tendency of the PCD table 102 to delaminate from the cemented carbide substrate 108 and/or chip. The melting temperature of pure cobalt at standard pressure conditions is about 1495° C.

Depending on the desired viscosity and melting temperature of the first infiltrant, more or less of the eutectic forming alloying constituent may be used. For example, a cobalt-silicon alloy cemented tungsten-carbide substrate may include about 0.01% by weight to about 1% by weight of silicon, or more specifically 0.5% by weight of silicon. The addition of the at least one eutectic forming alloying constituent (e.g., silicon) may decrease the liquidus temperature at standard pressure to not more than about 1400° C., not more than about 1350° C., or not more than about 1300° C. However, as discussed in more detail below, viscosity of the first infiltrant is not the only factor affecting infiltration of the PCD table. For example, the liquidus or melting temperature of a second infiltrant may affect the infiltration of the first infiltrant. A second infiltrant with a lower liquidus or melting temperature than the first infiltrant may melt and infiltrate the substantially empty interstitial pore spaces of a leached PCD table before the first infiltrant melts, thereby reducing/inhibiting infiltration of the first infiltrant, which may cause reduced bonding between the PCD table and substrate during a second HPHT process. Such reduced bonding increases delamination between the PCD table and the substrate.

The melting temperature of pure nickel at standard pressure conditions is about 1455° C. The addition of the at least one eutectic forming alloying constituent (e.g., silicon) may decrease the liquidus temperature at standard pressure to not more than 1450° C., not more than about 1400° C., not more than about 1350° C., not more than about 1300° C., not more than about 1250° C., or not more than about 1200° C.

Cobalt-Based Alloy Infiltrants

Cobalt-silicon is an embodiment of a cobalt-based alloy for the cobalt-based alloy first infiltrant that forms a eutectic composition at particular weight fractions of cobalt and silicon. For example, the cobalt-silicon phase diagram includes a eutectic composition at about 12.5% silicon by weight. By way of example, the amount of silicon in the cobalt-based alloy first infiltrant may be less than about 12.5%, about 5 to about 18.75%, about 1% to about 4%, about 1% to about 2.5%, about 2% to about 8%, about 3% to about 7%, less than about 2%, less than about 1%, about 0.5% to about 1.5%, about 0.25% to about 1%, about 0.1% to about 0.6%, or about 0.01% to about 0.1% silicon by weight of the cobalt-based alloy first infiltrant. At the eutectic composition, the liquidus temperature of the cobalt-silicon alloy is decreased from 1495° C. to about 1195° C. When employing the cobalt-silicon alloy as the cobalt-based alloy first infiltrant, there may be a tendency for the silicon to consume diamond, forming silicon carbide at the expense of diamond-to-diamond bonding. In order to limit this tendency, in an embodiment, it is not necessary to include such a high fraction of silicon to decrease the liquidus temperature and viscosity to the desired degree, as any amount up to the eutectic composition may be used. In another embodiment, the amount may be effective to reduce the liquidus temperature at standard pressure to not more than about 1400° C., not more than about 1350° C., not more than about 1300° C., or not more than about 1200° C. It is currently believed that limiting the amount of silicon may also limit formation of silicon carbide at the expense of diamond-to-diamond bonding during HPHT infiltration of the cobalt-based alloy first infiltrant.

Depending upon the fabrication technique used to form the cemented carbide substrate 108 and when the first infiltrant is included in the cemented carbide substrate 108 as a cementing constituent, the cobalt-based alloy first infiltrant of the cemented carbide substrate 108 may have less than about 12.5% by weight silicon in solid solution with cobalt, but silicon may be present in the cobalt-based alloy first infiltrant in the form of a substantially pure silicon phase, a silicon alloy phase, a silicide, silicon carbide, or combinations thereof. In other embodiments, substantially all of the silicon in the cemented carbide substrate 108 may be in solid solution with cobalt of the cobalt-based alloy first infiltrant in a supersaturated metastable state.

Cobalt-carbon is another embodiment of a cobalt-based alloy for the cobalt-based alloy first infiltrant that forms a eutectic composition. The cobalt-carbon phase diagram includes a eutectic composition at about 2.9% weight of carbon. By way of example, the amount of carbon in the cobalt-based alloy first infiltrant may be less than about 2.9%, about 1.45% to about 4.35%, about 1% to less than 2.9%, about 0.5% to about 2.5%, about 1% to about 2%, about 0.75% to about 1.5%, about 0.5% to about 1.5%, less than about 1%, less than about 0.5%, or less than about 0.25% carbon by weight of the cobalt-based alloy first infiltrant. In another embodiment, the amount may be effective to reduce the liquidus temperature at standard pressure to not more than about 1400° C., not more than about 1350° C., or not more than about 1300° C. At the eutectic composition, the liquidus temperature of the cobalt-carbon alloy is decreased from 1495° C. to about 1309° C.

Depending upon the fabrication technique used to form the cemented carbide substrate 108 and when the first infiltrant is included in the cemented carbide substrate 108 as a cementing constituent, the cobalt-based alloy first infiltrant of the cemented carbide substrate 108 may have less than about 2.9% by weight carbon, but carbon may be present in the cobalt-based alloy first infiltrant in another form, such as in the form of carbon rich carbide phases, graphite, or combinations thereof. In other embodiments, the cobalt-based alloy first infiltrant may have carbon present therein at or near the eutectic composition thereof in a supersaturated metastable state.

Cobalt-boron is another embodiment of a cobalt-based alloy for the cobalt-based alloy first infiltrant that forms a eutectic composition. The cobalt-boron phase diagram includes a eutectic composition at about 5.5 weight percent boron. By way of example, the amount of boron in the cobalt-based alloy first infiltrant may be less than 5.5%, about 2.2% to about 8.25%, about 1% to about 4%, about 1% to about 2.5%, about 2% to about 5%, about 3% to about 4% boron, less than about 2%, less than about 1%, or from about 0.5% to about 1.5% by weight of the cobalt-based alloy first infiltrant. At the eutectic composition, the liquidus temperature of the cobalt-boron alloy is decreased from 1495° C. to about 1102° C. Similar to cobalt-silicon, with cobalt-boron there may be a tendency for the boron to consume diamond, forming boron carbide at the expense of diamond-to-diamond bonding. Similar to the other eutectic forming alloying constituents, it may not be necessary to include such a high fraction of boron to achieve the desired decrease in melting temperature and viscosity. In another embodiment, the amount of boron may be effective to reduce the liquidus temperature at standard pressure to not more than about 1400° C., not more than about 1350° C., not more than about 1300° C., or not more than about 1200° C.

Depending upon the fabrication technique used to form the cemented carbide substrate 108 and when the first infiltrant is included in the cemented carbide substrate 108 as a cementing constituent, the cobalt-based alloy first infiltrant of the cemented carbide substrate 108 may have less than about 5.5% by weight boron, but boron may be present in the cobalt-based alloy first infiltrant that is not in solid solution with cobalt in the form of a substantially pure boron, boron carbide, one or more types of borides, or combinations thereof. In other embodiments, substantially all of the boron in the cemented carbide substrate 108 may be in the cobalt-based alloy first infiltrant in a supersaturated metastable state.

Cobalt-phosphorus is another embodiment of a cobalt-based alloy for the cobalt-based alloy first infiltrant that forms a eutectic composition. The cobalt-phosphorus phase diagram includes a eutectic composition at about 11.5 weight percent phosphorus. By way of example, the amount of phosphorus in the cobalt-based alloy first infiltrant may be less than 11.5%, about 4.6% to about 17.3%, about 1% to about 8%, about 7% to about 9%, about 5% to about 8%, about 3% to about 6%, less than about 3%, less than about 2%, less than about 1%, or about 0.5% to about 1.5% phosphorus by weight of the cobalt-based alloy first infiltrant. In another embodiment, the amount may be effective to reduce the liquidus temperature at standard pressure to not more than about 1400° C., not more than about 1350° C., not more than about 1300° C., or not more than about 1200° C. At the eutectic composition, the liquidus temperature of the cobalt-phosphorus alloy is decreased from 1495° C. to about 1023° C.

Depending upon the fabrication technique used to form the cemented carbide substrate 108 and when the first infiltrant is included in the cemented carbide substrate 108 as a cementing constituent, the cobalt-based alloy first infiltrant of the cemented carbide substrate 108 may have less than about 11.5% by weight phosphorus, but phosphorus may be present in the cobalt-based alloy first infiltrant that is not in solid solution with cobalt in the form of a substantially pure phosphorous, one or more types of phosphides, or combinations thereof. In other embodiments, substantially all of the phosphorus in the cemented carbide substrate 108 may be in the cobalt-based alloy first infiltrant in a supersaturated metastable state.

Cobalt-tantalum is another embodiment of a cobalt-based alloy for the cobalt-based alloy first infiltrant that forms a eutectic composition. The cobalt-tantalum phase diagram includes a eutectic composition at about 32.4 weight percent tantalum. By way of example, the amount of tantalum in the cobalt-based alloy first infiltrant may be less than 32.4%, about 13% to about 49%, about 10% to about 30%, about 15% to about 25%, about 5% to about 15%, about 3% to about 6%, less than about 10%, less than about 5%, less than 3%, or about 0.5% to about 1.5% tantalum by weight of the cobalt-based alloy first infiltrant. At the eutectic composition, the liquidus temperature of the cobalt-tantalum alloy is decreased from 1495° C. to about 1276° C. Similar to cobalt-silicon, with cobalt-tantalum there may be a tendency for the tantalum to consume diamond, forming tantalum carbide at the expense of diamond-to-diamond bonding. In embodiment, the amount may be effective to reduce the liquidus temperature at standard pressure to not more than about 1400° C., not more than about 1350° C., or not more than about 1300° C. Similar to the other eutectic forming alloying constituents, it may not be necessary to include such a high fraction of tantalum to achieve the desired decrease in melting temperature and viscosity. In other embodiment, any of the foregoing ranges for tantalum may be used for tantalum carbide or combinations of tantalum and tantalum carbide.

Depending upon the fabrication technique used to form the cemented carbide substrate 108 and when the first infiltrant is included in the cemented carbide substrate 108 as a cementing constituent, the cobalt-based alloy first infiltrant of the cemented carbide substrate 108 may have less than about 32.4% by weight tantalum, but tantalum may be present in the cobalt-based alloy first infiltrant that is not in solid solution with cobalt in the form of a substantially pure phase of tantalum, an alloy phase of tantalum, tantalum carbide, or combinations thereof. In other embodiments, substantially all of the tantalum in the cemented carbide substrate 108 may be in the cobalt-based alloy first infiltrant in a supersaturated metastable state.

An embodiment may include more than one of the foregoing eutectic forming alloying constituents. For example, an alloy and/or mixture of cobalt and tantalum carbide may be particularly beneficial as may provide high lubricity, better high temperature performance (because tantalum is a refractory metal), and may limit any tendency of tantalum alone to consume diamond in the formation of tantalum carbide, as the tantalum instead is already provided in the form of tantalum carbide.

Cobalt-niobium is another embodiment of a cobalt-based alloy for the cobalt-based alloy first infiltrant that forms a eutectic composition. The cobalt-niobium phase diagram includes a eutectic composition at about 21 weight percent niobium. By way of example, the amount of niobium in the cobalt-based alloy first infiltrant may be less than 21%, about 8.5% to about 31.5%, about 15% to about 20%, about 15% to about 25%, about 5% to about 15%, about 3% to about 6%, less than about 10%, less than about 5%, less than about 3%, about 1% to about 3% or about 0.5% to about 1.5% niobium by weight of the cobalt-based alloy first infiltrant. In another embodiment, the amount may be effective to reduce the liquidus temperature at standard pressure to not more than about 1400° C., not more than about 1350° C., or not more than about 1300° C. At the eutectic composition, the liquidus temperature of the cobalt-phosphorus alloy is decreased from 1495° C. to about 1235° C.

Depending upon the fabrication technique used to form the cemented carbide substrate 108 and when the first infiltrant is included in the cemented carbide substrate 108 as a cementing constituent, the cobalt-based alloy first infiltrant of the cemented carbide substrate 108 may have less than about 21% by weight niobium, but niobium may be present in the cobalt-based alloy first infiltrant that is not in solid solution with cobalt in the form of a substantially pure niobium phase, an alloy phase of niobium, niobium carbide, or combinations thereof. In other embodiments, substantially all of the niobium in the cemented carbide substrate 108 may be in the cobalt-based alloy first infiltrant in a supersaturated metastable state.

Cobalt-molybdenum is another embodiment of a cobalt-based alloy for the cobalt-based alloy first infiltrant that forms a eutectic composition. The cobalt-molybdenum phase diagram includes a eutectic composition at about 37 weight percent molybdenum. By way of example, the amount of molybdenum in the cobalt-based alloy first infiltrant may be less than 37%, about 15% to about 56%, about 10% to about 30%, about 15% to about 25%, about 5% to about 15%, about 3% to about 6%, less than about 10%, less than about 5%, less than about 3%, or about 0.5% to about 1.5% molybdenum by weight of the cobalt-based alloy first infiltrant. In another embodiment, the amount may be effective to reduce the liquidus temperature at standard pressure to not more than about 1400° C., or not more than about 1350° C. At the eutectic composition, the liquidus temperature of the cobalt-molybdenum alloy is decreased from 1495° C. to about 1340° C. Similar to cobalt-silicon, with cobalt-molybdenum there may be a tendency for the molybdenum to consume diamond, forming molybdenum carbide at the expense of diamond-to-diamond bonding. Similar to the other eutectic forming alloying constituents, it may not be necessary to include such a high fraction of molybdenum to achieve the desired decrease in melting temperature and viscosity.

Depending upon the fabrication technique used to form the cemented carbide substrate 108 and when the first infiltrant is included in the cemented carbide substrate 108 as a cementing constituent, the cobalt-based alloy first infiltrant of the cemented carbide substrate 108 may have less than about 37% by weight molybdenum, but molybdenum may be present in the cobalt-based alloy first infiltrant that is not in solid solution with cobalt in the form of a substantially pure molybdenum phase, an alloy phase of molybdenum, molybdenum carbide, or combinations thereof. In other embodiments, substantially all of the molybdenum in the cemented carbide substrate 108 may be in the cobalt-based alloy first infiltrant in a supersaturated metastable state.

Cobalt-antimony is another embodiment of a cobalt alloy for the cobalt-based alloy first infiltrant that forms a eutectic composition. The cobalt-antimony phase diagram includes a eutectic composition at about 41.4 weight percent antimony. By way of example, the amount of antimony in the cobalt-based alloy first infiltrant may be less than 41%, about 16% to about 62%, about 10% to about 30%, about 15% to about 25%, about 25% to about 35%, about 3% to about 6%, less than about 10%, less than about 5%, less than about 3%, or about 0.5% to about 1.5% antimony by weight of the cobalt-based alloy first infiltrant. At the eutectic composition, the liquidus temperature of the cobalt-antimony alloy is decreased from 1495° C. to about 1095° C.

Depending upon the fabrication technique used to form the cemented carbide substrate 108 and when the first infiltrant is included in the cemented carbide substrate 108 as a cementing constituent, the cobalt-based alloy first infiltrant of the cemented carbide substrate 108 may have less than about 41% by weight antimony, but antimony may be present in the cobalt-based alloy first infiltrant that is not in solid solution with cobalt in the form of a substantially pure antimony phase, an alloy phase of antimony, or combinations thereof. In another embodiment, the amount may be effective to reduce the liquidus temperature at standard pressure to not more than about 1400° C., not more than about 1350° C., not more than about 1300° C., or not more than 1200° C. In other embodiments, substantially all of the antimony in the cemented carbide substrate 108 may be in the cobalt-based alloy first infiltrant in a supersaturated metastable state.

Cobalt-tin is another embodiment of a cobalt alloy for the cobalt-based alloy first infiltrant that forms a eutectic composition. The cobalt-tin phase diagram includes a eutectic composition at about 34 weight percent tin. By way of example, the amount of antimony in the cobalt-based alloy first infiltrant may be less than 41%, about 14% to about 51%, about 10% to about 30%, about 15% to about 25%, about 25% to about 35%, about 20% to about 35%, about 3% to about 6%, less than about 10%, less than about 5%, less than about 3%, or about 0.5% to about 1.5% tin by weight of the cobalt-based alloy first infiltrant. At the eutectic composition, the liquidus temperature of the cobalt-tin alloy is decreased from 1495° C. to about 1112° C.

Depending upon the fabrication technique used to form the cemented carbide substrate 108 and when the first infiltrant is included in the cemented carbide substrate 108 as a cementing constituent, the cobalt-based alloy first infiltrant of the cemented carbide substrate 108 may have less than about 34% by weight tin, but tin may be present in the cobalt-based alloy first infiltrant that is not in solid solution with cobalt in the form of a substantially pure tin phase, an alloy phase of tin, or combinations thereof. In another embodiment, the amount may be effective to reduce the liquidus temperature at standard pressure to not more than about 1400° C., not more than about 1350° C., not more than about 1300° C., or not more than about 1200° C. In other embodiments, substantially all of the tin in the cemented carbide substrate 108 may be in the cobalt-based alloy first infiltrant in a supersaturated metastable state.

It is contemplated that combinations of various eutectic forming alloying constituents may be employed such as, for example, a cobalt-tantalum carbide alloy. In addition, with any of the foregoing eutectic forming alloying constituents, it is not necessary that the actual eutectic composition (i.e., where melting temperature is at its lowest) be used, as any amount up to this point (hypo-eutectic) may be used. In some embodiments, amounts above the eutectic composition (hyper-eutectic) may be employed. That said, in some embodiments, amounts above the actual eutectic composition point are not used, in order to avoid the formation of undesirable intermetallic compounds, which can often be brittle. Further, in some embodiments, those eutectic forming alloying constituents in which the eutectic composition is relatively low (e.g., less than about 15% by weight) may be employed as a greater decrease in liquidus temperature and viscosity is achieved with the inclusion of very small weight fractions (e.g., no more than about 5%) of alloying material. Examples of such eutectic forming alloying constituents include carbon, silicon, boron, and phosphorus. Where the eutectic point requires a higher fraction of alloying material, the slope of the melting temperature decrease is significantly more gradual, requiring the addition of large amounts of eutectic forming alloying constituent(s) to achieve the desired decrease in viscosity. Such large amounts of eutectic forming alloying constituents may be more likely to also provide unwanted side effects with such drastic changes to the composition.

Nickel-Based Alloy Infiltrants

Nickel-silicon is an embodiment of a nickel-based alloy for a nickel-based alloy first infiltrant that forms a eutectic composition at particular weight fractions of nickel and silicon. A nickel-silicon alloy may be used in a manner substantially similar to that described above for a cobalt-silicon alloy. For example, the nickel-silicon phase diagram includes a eutectic composition at about 11.5% silicon by weight. By way of example, the amount of silicon in the nickel-based alloy first infiltrant may be less than about 11.5%, less than about 7%, about 3% to about 17.5%, about 1% to about 10%, about 2% to about 8%, about 3% to about 7%, less than about 2%, less than about 1%, about 0.5% to about 1.5%, about 0.25% to about 1%, or about 0.1% to about 0.6% silicon by weight of the nickel-based alloy first infiltrant. In another embodiment, the amount may be effective to reduce the liquidus temperature at standard pressure to not more than about 1400° C., not more than about 1350° C., not more than about 1300° C., or not more than about 1200° C. At the eutectic composition, the liquidus temperature of the nickel-silicon alloy is decreased from 1455° C. to about 1152° C. When employing the nickel-silicon alloy as the nickel-based alloy first infiltrant, there may be a tendency for the silicon to consume diamond, forming silicon carbide at the expense of diamond-to-diamond bonding. In order to limit this tendency, in an embodiment, it is not necessary to include such a high fraction of silicon to decrease the liquidus temperature and viscosity to the desired degree, as any amount up to the eutectic composition may be used. It is currently believed that limiting the amount of silicon may also limit formation of silicon carbide at the expense of diamond-to-diamond bonding during HPHT infiltration of the nickel-based alloy first infiltrant.

Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 11.5% by weight silicon in solid solution with nickel, but silicon may be present in the nickel-based alloy first infiltrant in the form of a substantially pure silicon phase, a silicon alloy phase, a silicide, silicon carbide, or combinations thereof. In other embodiments, substantially all of the silicon in the cemented carbide substrate 108 may be in solid solution with nickel of the nickel-based alloy first infiltrant in a supersaturated metastable state.

Nickel-carbon is another embodiment of a nickel-based alloy for the nickel-based alloy first infiltrant that forms a eutectic composition. The nickel-carbon phase diagram includes a eutectic composition at about 2.22% weight of carbon. By way of example, the amount of carbon in the nickel-based alloy first infiltrant may be less than about 2.22%, about 1% to about 5%, about 1% to less than 2.22%, about 0.5% to about 2%, about 1% to about 2%, about 0.75% to about 1.5%, about 0.5% to about 1.5%, less than about 1%, less than about 0.5%, or less than about 0.25% carbon by weight of the nickel-based alloy first infiltrant. In another embodiment, the amount may be effective to reduce the liquidus temperature at standard pressure to not more than about 1400° C., or not more than about 1350° C. At the eutectic composition, the liquidus temperature of the nickel-carbon alloy is decreased from 1455° C. to about 1318° C.

Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 2.22% by weight carbon, but carbon may be present in the nickel-based alloy first infiltrant in another form, such as in the form of carbon rich carbide phases, graphite, or combinations thereof. In other embodiments, the nickel-based alloy first infiltrant may have carbon present therein at or near the eutectic composition thereof in a supersaturated metastable state.

Nickel-boron is another embodiment of a nickel-based alloy for the nickel-based alloy first infiltrant that forms a eutectic composition. The nickel-boron phase diagram includes a eutectic composition at about 4 weight percent boron. By way of example, the amount of boron in the nickel-based alloy first infiltrant may be less than 4%, about 2% to about 8.25%, about 1% to about 4%, about 1% to about 2.5%, less than about 2%, less than about 1%, about 0.5% to about 1.5%, about 2% to about 5%, or about 3% to about 4% boron by weight of the nickel-based alloy first infiltrant. In another embodiment, the amount of boron may be effective to reduce the liquidus temperature at standard pressure to not more than about 1400° C., not more than about 1350° C., not more than about 1300° C., or not more than about 1200° C. At the eutectic composition, the liquidus temperature of the nickel-boron alloy is decreased from 1455° C. to about 1140° C. Similar to nickel-silicon, with nickel-boron there may be a tendency for the boron to consume diamond, forming boron carbide at the expense of diamond-to-diamond bonding. Similar to the other eutectic forming alloying constituents, it may not be necessary to include such a high fraction of boron to achieve the desired decrease in melting temperature and viscosity.

Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 4% by weight boron, but boron may be present in the nickel-based alloy first infiltrant that is not in solid solution with nickel in the form of a substantially pure boron, boron carbide, one or more types of borides, or combinations thereof. In other embodiments, substantially all of the boron in the cemented carbide substrate 108 may be in the nickel-based alloy first infiltrant in a supersaturated metastable state.

Nickel-phosphorus is another embodiment of a nickel-based alloy for the nickel-based alloy first infiltrant that forms a eutectic composition. The nickel-phosphorus phase diagram includes a eutectic composition at about 11 weight percent phosphorus. By way of example, the amount of phosphorus in the nickel-based alloy first infiltrant may be less than 11%, about 4% to about 15%, about 1% to about 8%, less than about 3%, less than about 2%, less than about 1%, about 0.5% to about 1.5%, about 7% to about 9%, about 5% to about 8%, or about 3% to about 6% phosphorus by weight of the nickel-based alloy first infiltrant. In another embodiment, the amount may be effective to reduce the liquidus temperature at standard pressure to not more than about 1400° C., not more than about 1350° C., not more than about 1300° C., or not more than about 1200° C. At the eutectic composition, the liquidus temperature of the nickel-phosphorus alloy is decreased from 1455° C. to about 880° C.

Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 11% by weight phosphorus, but phosphorus may be present in the nickel-based alloy first infiltrant that is not in solid solution with nickel in the form of a substantially pure phosphorous, one or more types of phosphides, or combinations thereof. In other embodiments, substantially all of the phosphorus in the cemented carbide substrate 108 may be in the nickel-based alloy first infiltrant in a supersaturated metastable state.

Nickel-tantalum is another embodiment of a nickel-based alloy for the nickel-based alloy first infiltrant that forms a eutectic composition. The nickel-tantalum phase diagram includes a eutectic composition at about 38 weight percent tantalum. By way of example, the amount of tantalum in the nickel-based alloy first infiltrant may be less than 38%, about 10% to about 49%, about 10% to about 35%, about 15% to about 25%, less than about 10%, less than about 5%, less than about 3%, about 0.5% to about 1.5%, about 5% to about 15%, or about 3% to about 6% tantalum by weight of the nickel-based alloy first infiltrant. In another embodiment, the amount may be effective to reduce the liquidus temperature at standard pressure to not more than about 1400° C. At the eutectic composition, the liquidus temperature of the nickel-tantalum alloy is decreased from 1455° C. to about 1360° C. Similar to nickel-silicon, with nickel-tantalum there may be a tendency for the tantalum to consume diamond, forming tantalum carbide at the expense of diamond-to-diamond bonding. Similar to the other eutectic forming alloying constituents, it may not be necessary to include such a high fraction of tantalum to achieve the desired decrease in melting temperature and viscosity. In other embodiments, any of the foregoing ranges for tantalum may be used for tantalum carbide or combinations of tantalum and tantalum carbide.

Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 38% by weight tantalum, but tantalum may be present in the nickel-based alloy first infiltrant that is not in solid solution with nickel in the form of a substantially pure phase of tantalum, an alloy phase of tantalum, tantalum carbide, or combinations thereof. In other embodiments, substantially all of the tantalum in the cemented carbide substrate 108 may be in the nickel-based alloy first infiltrant in a supersaturated metastable state.

An embodiment may include more than one of the foregoing eutectic forming alloying constituents. For example, an alloy and/or mixture of nickel and tantalum carbide may be particularly beneficial as it may provide high lubricity, better high temperature performance (because tantalum is a refractory metal), and may limit any tendency of tantalum alone to consume diamond in the formation of tantalum carbide, as the tantalum instead is already provided in the form of tantalum carbide.

Another embodiment including more than one of the foregoing eutectic forming alloying constituents is an alloy and/or mixture of nickel, boron, and silicon. Such a ternary alloy may include any of the weight fractions of silicon and boron as described above, with the balance comprising nickel. For example, one embodiment of such ternary alloy may include about 2% to about 4.5% silicon by weight, about 2% to about 3.2% boron by weight, and the balance nickel (about 92.3% Ni to about 96% by weight). Other examples may include less or more than about 4.5% silicon, less or more than about 3% boron, and the balance nickel. For example, boron and/or silicon (with the balance being substantially nickel) may be less than about 10% by weight, less than about 9% by weight, less than about 8% by weight, less than about 6% by weight, less than about 5% by weight, less than about 4% by weight, less than about 3% by weight, less than about 2% by weight, less than about 1% by weight, about 1% to about 3.5% by weight, or about 2% to about 3.5% by weight. For example, boron may be less than about 5% by weight, less than about 4% by weight, less than about 3% by weight, less than about 2% by weight, less than about 1% by weight, about 1% to about 3.5% by weight, or about 2% to about 3.5% by weight. For example, silicon may be less than about 5% by weight, less than about 4% by weight, less than about 3% by weight, less than about 2% by weight, less than about 1% by weight, about 1% to about 4.5% by weight, or about 2% to about 4.5% by weight. Such tertiary alloys may be expected to provide a ternary eutectic temperature between that exhibited by a Ni—Si eutectic (e.g., about 1152° C.) and a Ni—B eutectic (e.g., about 1140° C.). In addition, the presence of boron improves the wetting angle between the carbide substrate and the foil, providing better bonding than might otherwise be achieved. In another embodiment, such a ternary alloy may be effective to reduce the liquidus temperature at standard pressure to not more than 1450° C., not more than about 1400° C., not more than about 1350° C., or not more than about 1300° C.

Nickel-niobium is another embodiment of a nickel-based alloy for the nickel-based alloy first infiltrant that forms a eutectic composition. The nickel-niobium phase diagram includes a eutectic composition at about 23.5 weight percent niobium. By way of example, the amount of niobium in the nickel-based alloy first infiltrant may be less than 23.5%, about 8% to about 32%, about 15% to about 20%, about 15% to about 25%, about 5% to about 15%, about 3% to about 6%, less than about 10%, less than about 5%, less than about 3%, about 1% to about 3% or about 0.5% to about 1.5% niobium by weight of the nickel-based alloy first infiltrant. At the eutectic composition, the liquidus temperature of the nickel-niobium alloy is decreased from 1455° C. to about 1270° C.

Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 23.5% by weight niobium, but niobium may be present in the nickel-based alloy first infiltrant that is not in solid solution with nickel in the form of a substantially pure niobium phase, an alloy phase of niobium, niobium carbide, or combinations thereof. In other embodiments, substantially all of the niobium in the cemented carbide substrate 108 may be in the nickel-based alloy first infiltrant in a supersaturated metastable state. In another embodiment, the amount may be effective to reduce the liquidus temperature at standard pressure to not more than 1400° C., not more than about 1350° C., or not more than about 1300° C. At the eutectic composition, the liquidus temperature of the nickel-niobium alloy is decreased from 1455° C. to about 1270° C.

Nickel-molybdenum is another embodiment of a nickel-based alloy for the nickel-based alloy first infiltrant that forms a eutectic composition. The nickel-molybdenum phase diagram includes a eutectic composition at about 49 weight percent molybdenum. By way of example, the amount of molybdenum in the nickel-based alloy first infiltrant may be less than 49%, about 15% to about 60%, about 15% to about 35%, about 20% to about 30%, about 5% to about 15%, about 3% to about 6%, less than about 10%, less than about 5%, less than about 3%, or about 0.5% to about 1.5% molybdenum by weight of the nickel-based alloy first infiltrant. In another embodiment, the amount may be effective to reduce the liquidus temperature at standard pressure to not more than 1450° C., not more than 1400° C., or not more than about 1350° C. At the eutectic composition, the liquidus temperature of the nickel-molybdenum alloy is decreased from 1455° C. to about 1315° C. Similar to nickel-silicon, with nickel-molybdenum there may be a tendency for the molybdenum to consume diamond, forming molybdenum carbide at the expense of diamond-to-diamond bonding. Similar to the other eutectic forming alloying constituents, it may not be necessary to include such a high fraction of molybdenum to achieve the desired decrease in melting temperature and viscosity.

Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 49% by weight molybdenum, but molybdenum may be present in the nickel-based alloy first infiltrant that is not in solid solution with nickel in the form of a substantially pure molybdenum phase, an alloy phase of molybdenum, molybdenum carbide, or combinations thereof. In other embodiments, substantially all of the molybdenum in the cemented carbide substrate 108 may be in the nickel-based alloy first infiltrant in a supersaturated metastable state.

Nickel-cerium is another embodiment of a nickel-based alloy for the nickel-based alloy first infiltrant that forms a eutectic composition. The nickel-cerium phase diagram includes a eutectic composition at about 19 weight percent cerium. By way of example, the amount of cerium in the nickel-based alloy first infiltrant may be less than 19%, about 5% to about 25%, about 10% to about 15%, about 15% to about 25%, about 5% to about 15%, about 3% to about 6%, less than about 5%, less than about 3%, less than about 2%, or about 0.5% to about 1.5% cerium by weight of the nickel-based alloy first infiltrant. In another embodiment, the amount may be effective to reduce the liquidus temperature at standard pressure to not more than about 1400° C., not more than about 1350° C., or not more than about 1300° C. At the eutectic composition, the liquidus temperature of the nickel-cerium alloy is decreased from 1455° C. to about 1210° C. Similar to nickel-silicon, with nickel-cerium there may be a tendency for the cerium to consume diamond, forming cerium carbide at the expense of diamond-to-diamond bonding. Similar to the other eutectic forming alloying constituents, it may not be necessary to include such a high fraction of cerium to achieve the desired decrease in melting temperature and viscosity.

Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 19% by weight cerium, but cerium may be present in the nickel-based alloy first infiltrant that is not in solid solution with nickel in the form of a substantially pure cerium phase, an alloy phase of cerium, cerium carbide, or combinations thereof. In other embodiments, substantially all of the cerium in the cemented carbide substrate 108 may be in the nickel-based alloy first infiltrant in a supersaturated metastable state.

Nickel-titanium is another embodiment of a nickel-based alloy for the nickel-based alloy first infiltrant that forms a eutectic composition. The nickel-titanium phase diagram includes a eutectic composition at about 16.2 weight percent titanium. By way of example, the amount of titanium in the nickel-based alloy first infiltrant may be less than 16.2%, about 3% to about 20%, about 5% to about 16.2%, about 10% to about 16.2%, about 5% to about 15%, about 3% to about 6%, less than about 5%, less than about 3%, or about 0.5% to about 1.5% titanium by weight of the nickel-based alloy first infiltrant. In another embodiment, the amount may be effective to reduce the liquidus temperature at standard pressure to not more than 1400° C., not more than about 1350° C., or not more than about 1300° C. At the eutectic composition, the liquidus temperature of the nickel-titanium alloy is decreased from 1455° C. to about 1287° C. Similar to nickel-silicon, with nickel-titanium there may be a tendency for the titanium to consume diamond, forming titanium carbide at the expense of diamond-to-diamond bonding. Similar to the other eutectic forming alloying constituents, it may not be necessary to include such a high fraction of titanium to achieve the desired decrease in melting temperature and viscosity.

Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 16.2% by weight titanium, but titanium may be present in the nickel-based alloy first infiltrant that is not in solid solution with nickel in the form of a substantially pure titanium phase, an alloy phase of titanium, titanium carbide, or combinations thereof. In other embodiments, substantially all of the titanium in the cemented carbide substrate 108 may be in the nickel-based alloy first infiltrant in a supersaturated metastable state.

Nickel-antimony is another embodiment of a nickel alloy for the nickel-based alloy first infiltrant that forms a eutectic composition. The nickel-antimony phase diagram includes a eutectic composition at about 36 weight percent antimony. By way of example, the amount of antimony in the nickel-based alloy first infiltrant may be less than 36%, about 15% to about 50%, about 10% to about 30%, about 15% to about 25%, about 25% to about 36%, about 3% to about 6%, less than about 10%, less than about 5%, less than about 3%, or about 0.5% to about 1.5% antimony by weight of the nickel-based alloy first infiltrant. In another embodiment, the amount may be effective to reduce the liquidus temperature at standard pressure to not more than 1400° C., not more than about 1350° C., not more than about 1300° C., or not more than about 1200° C. At the eutectic composition, the liquidus temperature of the nickel-antimony alloy is decreased from 1455° C. to about 1097° C. Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 36% by weight antimony, but antimony may be present in the nickel-based alloy first infiltrant that is not in solid solution with nickel in the form of a substantially pure antimony phase, an alloy phase of antimony, or combinations thereof. In other embodiments, substantially all of the antimony in the cemented carbide substrate 108 may be in the nickel-based alloy first infiltrant in a supersaturated metastable state.

Nickel-tin is another embodiment of a nickel alloy for the nickel-based alloy first infiltrant that forms a eutectic composition. The nickel-tin phase diagram includes a eutectic composition at about 32.5 weight percent tin. By way of example, the amount of tin in the nickel-based alloy first infiltrant may be less than 32.5%, about 15% to about 40%, about 10% to about 32.5%, about 15% to about 25%, about 25% to about 35%, about 20% to about 35%, about 3% to about 6%, less than 10%, less than 5%, less than 3%, or about 0.5% to about 1.5% tin by weight of the nickel-based alloy first infiltrant. In another embodiment, the amount may be effective to reduce the liquidus temperature at standard pressure to not more than 1400° C., not more than about 1350° C., not more than about 1300° C., or not more than about 1200° C. At the eutectic composition, the liquidus temperature of the nickel-tin alloy is decreased from 1455° C. to about 1130° C. Depending upon the fabrication technique used to form the cemented carbide substrate 108 and when the first infiltrant is included in the cemented carbide substrate 108 as a cementing constituent, the nickel-based alloy first infiltrant of the cemented carbide substrate 108 may have less than about 32.5% by weight tin, but tin may be present in the nickel-based alloy first infiltrant that is not in solid solution with nickel in the form of a substantially pure tin phase, an alloy phase of tin, or combinations thereof. In other embodiments, substantially all of the tin in the cemented carbide substrate 108 may be in the nickel-based alloy first infiltrant in a supersaturated metastable state.

It is contemplated that combinations of various eutectic forming alloying constituents may be employed such as, for example, a nickel-tantalum carbide alloy or a nickel-silicon-boron alloy. In addition, with any of the foregoing eutectic forming alloying constituents, it is not necessary that the actual eutectic composition (i.e., where melting temperature is at its lowest) be used, as any amount up to this point (hypo-eutectic), may be used. In some embodiments, amounts above the eutectic composition (hyper-eutectic) may be employed. That said, in some embodiments, amounts above the actual eutectic composition point are not used, in order to avoid the formation of undesirable intermetallic compounds, which can often be brittle. Further, in some embodiments, those eutectic forming alloying constituents in which the eutectic composition is relatively low (e.g., less than about 15% by weight) may be employed as a greater decrease in liquidus temperature and viscosity is achieved with the inclusion of very small weight fractions (e.g., less than about 5%, less than about 3%, less than about 1%) of alloying material. Examples of such eutectic forming alloying constituents include carbon, silicon, boron, and phosphorus. Where the eutectic point requires a higher fraction of alloying material, the slope of the melting temperature decrease is significantly more gradual, requiring the addition of large amounts of eutectic forming alloying constituent(s) to achieve the desired decrease in viscosity. Such large amounts of eutectic forming alloying constituents may be more likely to also provide unwanted side effects with such drastic changes to the composition.

The inventors currently believe that the infiltration depth "h" is primarily governed by capillary action, which depends heavily on the viscosity, surface energy, and contact angle of the infiltrant, as well as the radius or size of the interstitial regions of the PCD table 102 infiltrated with the infiltrant and the time period over which the HPHT conditions are maintained. For example, according to one theory, the infiltration depth "h" is approximated by the mathematical expression below:

$$h = \frac{2}{\pi}\left[\frac{rt\gamma\cos\vartheta}{2\nu}\right]^{\frac{1}{2}}$$

where:

h=infiltration depth;

r=radius of the interstitial regions of the PCD table 102 infiltrated with the infiltrant;

t=infiltration time;

$\vartheta$=contact angle of the infiltrant with the PCD table 102;

$\gamma$=surface energy of the infiltrant; and $\nu$=viscosity of the infiltrant, which depends on temperature and pressure.

When the PDC table includes an extremely fine porous structure, the radius "r" of the interstitial regions of the PCD table 102 is extremely small. Such extremely fine porosity may be particularly associated with PCD tables formed under exceptionally high pressure conditions (e.g., at a cell pressure of at least about 7.5 GPa) in order to achieve enhanced diamond-to-diamond bonding. U.S. Pat. No. 7,866,418, incorporated herein by reference in its entirety, discloses PCD tables and associated PDCs formed under such exceptional conditions. Such enhanced diamond-to-diamond bonding is believed to occur as a result of the sintering pressure (e.g., at least about 7.5 GPa cell pressure) employed during the HPHT process being further into the diamond stable region and away from the graphite-diamond equilibrium line. The PCD tables disclosed in U.S. Pat. No. 7,866,418, as well as methods of fabrication disclosed therein, may be particularly suited for use with the embodiments disclosed herein employing a low viscosity cobalt-based and/or nickel-based alloy first infiltrant to minimize or prevent delamination and chipping.

The inventors have observed that when a PCD table includes an average pore size indicative of moderate sintering cell pressures (i.e., about 5 to 6 GPa), and when a metal-solvent catalyst content in the PCD table of about 1.2% by weight or more after leaching, there is an increase in the amount of delamination between the PCD table and the substrate. The inventors believe this is due in part to reduced porosity in the PCD table which inhibits infiltration and/or bonding to a substrate. It is believed that the radius "r" of the interstitial regions of the PCD table 102 formed at standard pressure (e.g., about 5-6 GPa) and/or including a metal-solvent catalyst content of about 1.2% by weight or more after leaching, is extremely small. Further, a PCD table sintered at cell pressures exceeding 7.5 GPa cell pressure may exhibit even smaller interstitial regions and/or may include metal solvent catalyst content of about 1.0% by weight or more after leaching. Therefore, low viscosity infiltrants may be desired to infiltrate PCD tables sintered at high cell pressures of about 7.5 GPa or greater cell pressures in a second HPHT process, which bonds the PCD table 102 to the substrate upon cooling.

According to one theory, infiltration occurs through capillary action rather than a pressure differential. The viscosity of the cobalt-based and/or nickel-based alloy first infiltrant increases at increased pressures, causing less infiltration to occur than at lower pressures, all else being equal. Viscosity is also affected by temperature, i.e., as temperature increases, viscosity decreases, so that at higher temperatures, increased infiltration results. However, increasing the processing temperature may result in undesirable side effects, including back conversion of diamond to graphite and/or carbon monoxide. For this reason, embodiments of the invention seek to process the PDC without significant increases to temperature, but by selecting the composition of the cobalt-based and/or nickel-based alloy first infiltrant so that it exhibits greater viscosity at the given particular temperature and pressure. Alloying cobalt and/or nickel with at least one eutectic forming alloying constituent (e.g., silicon) so that the cobalt-based and/or nickel-based alloy first infiltrant exhibits a composition at or near a eutectic composition reduces both the liquidus temperature and viscosity of the cobalt-based and/or nickel-based alloy.

The temperature, pressure, and time period during the HPHT process used for attachment of the PCD table 102 to the cemented carbide substrate 108 may be controlled so as to provide for a desired infiltration depth "h." Partial infiltration of the PCD table 102 may provide the same or better wear resistance and/or thermal stability characteristics of a leached PCD table integrally formed on a substrate (i.e., a one-step PDC) without actual leaching of the infiltrant having to be performed, as the infiltrant does not fully infiltrate to the working surface 106 of the PCD table 102 (e.g., where the second infiltrant is removed or similarly partially infiltrated). In some embodiments, the PCD table 102 may be leached to remove a portion of the infiltrant(s) from the first region 110 to improve the uniformity of infiltrant(s) in the first region 110, thermal stability, wear resistance, or combinations of the foregoing. Additional details about controlling infiltration that may be used to practice embodiments of the invention are disclosed in U.S. application Ser. No. 12/961,787, the disclosure of which is incorporated herein, in its entirety, by this reference.

It is noted that a nonplanar interface 114 may be present between the first region 110 and the second region 112. One effect of this characteristic is that this nonplanar interface 114 between the first region 110 and the second region 112 differs from an otherwise similarly appearing PDC, but in which a region similar to second region 112 (in that it is substantially void of infiltrant) is formed by leaching, particularly if the PCD table 102 includes a chamfer formed therein. In such instances, the leaching profile advances from the outer surfaces exposed to the leaching acid.

For example, leaching typically progresses from the exterior surfaces downward and/or inward so that any chamfer or end exposed to the acid affects the leaching profile. Partial infiltration operates by a different mechanism. For example, infiltration may occur from the interface 109 into the PCD table 102 so that the presence of the chamfer 107 in the PCD table 102 does not affect the infiltration profile of the infiltrant. Additionally, if the infiltrant had infiltrated the entire PCD table 102 so that the interstitial regions of the second region 112 were also occupied by the infiltrant and subsequently removed in a leaching process to the depth "d," a boundary between the first region 110 and the second region 112 would be indicative of being defined by a leaching process.

As will be discussed in more detail below, the PCD table 102 may be formed separately from the cemented carbide substrate 108, and the PCD table 102 may be subsequently attached to the cemented carbide substrate 108 (i.e., a two-step PDC). For example, in an embodiment, the PCD table 102 may be integrally formed with a first cemented carbide substrate, after which the first cemented carbide substrate is removed, the separated PCD table is at least partially leached, and the at least partially leached PCD table is then attached to the cemented carbide substrate 108 in a second HPHT process. In another embodiment, the PCD table 102 may be formed without using a cemented carbide substrate (e.g., by subjecting diamond particles and a metal-solvent catalyst to a HPHT process), after which the formed PCD table is at least partially leached and attached to the cemented carbide substrate 108. During attachment of PCD table 102 to the cemented carbide substrate 108, a cobalt-based and/or nickel-based alloy first infiltrant is employed to metallurgically bond PCD table 102 to substrate 108. During attachment of the PCD table 102 to the cemented carbide substrate 108, a second infiltrant may be employed to fill the interstitial regions of the at least partially leached PCD table 102. For example, a second infiltrant may be infiltrated from the working surface 106 of the PCD table 102. In an embodiment, the second infiltrant may be provided to fill the interstitial regions of the at least partially leached PCD table 102 after attachment of the PCD table to the cemented carbide substrate. Optionally, the attached and infiltrated PCD table may be at least partially leached to a selected depth similar to those described above regarding FIGS. 1A-D to remove at least a portion of one or both of the first and/or second infiltrants therefrom.

When attaching the PCD table 102 to the cemented carbide substrate 108 in a second HPHT process, the HPHT process conditions (e.g., maximum temperature, maximum pressure, and total process time) may be specifically chosen to result in only partial infiltration of the first and second infiltrants into the PCD table 102. As a result of this second HPHT process, the cobalt-based and/or nickel-based alloy first infiltrant provided from the cemented carbide substrate 108 may infiltrate from the cemented carbide substrate 108

(or a structure placed between the substrate 108 and the PCD table 102) into at least some of the interstitial regions of PCD table 102 in the first region 110. Additional details of such methods by which a PCD table 102 may be attached to a cemented carbide substrate after formation of the PCD table are disclosed in U.S. patent application Ser. No. 12/961,787 filed 7 Dec. 2010 incorporated herein, in its entirety, by reference.

Figure 1E:
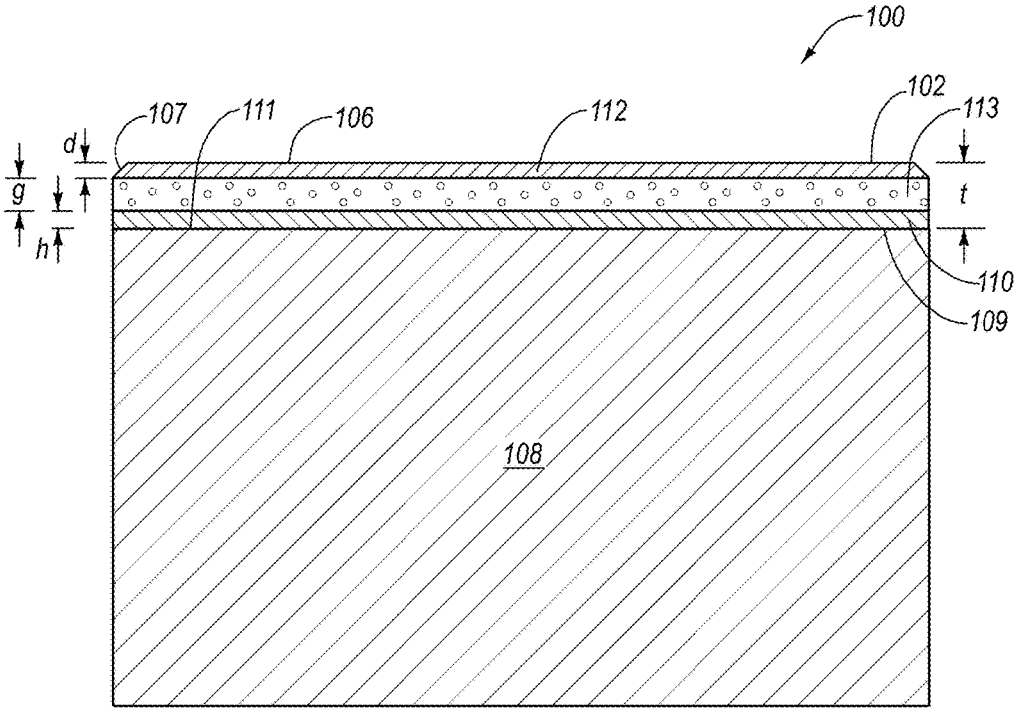
FIG. 1E is a cross-sectional view of the PDC of FIG. 1A in which the PCD table leached to a selected depth and subsequently infiltrated with a first and second infiltrant.

FIG. 1E is a cross-sectional view of the PDC of FIG. 1A in which the PCD table is leached to a selected depth and subsequently bonded to a substrate and infiltrated with a first and second infiltrant. In an embodiment, the PDC 100 may be fabricated by bonding a plurality of diamond grains in the presence of a metal-solvent catalyst in a first HPHT process substantially as any of those described herein including a relatively lower cell pressure (e.g., about 5-6 GPa) or a relatively higher cell pressure (e.g., greater than 7.5 GPa), leaching the resulting PCD table, and then attaching the at least partially leached PCD table to a substrate in a second HPHT process. The at least partially leached PCD table 102 may include a lateral surface 104, an upper working surface 106, a chamfer 107, and a back surface 111 generally opposite the working surface 106 and adjacent to the interfacial surface 109 of the substrate 108. In an embodiment, the PCD table may include a first region 110 located at or near the interfacial surface 109 and extending inward therefrom to a depth d, a second region 112 located at or near the working surface 106 and extending inward therefrom to a infiltration distance h, and a third region 113. The third region 113 may extend a segregation distance "g" between the depth d and the infiltration distance h. The segregation distance "g" may be at least about 200 μm, at least about 500 μm, about 200 μm to about 600 μm, about 500 μm to about 2100 μm, about 750 μm to about 2100 μm, about 950 μm to about 1500 μm, about 1000 μm to about 1750 μm, about 1000 μm to about 2000 μm, about 1500 μm to about 2000 μm, at least about a fifth, at least about a third of the thickness of the PCD table 102, about half of the thickness of the PCD table 102, or at least about more than half of the thickness of the PCD table 102. In such an embodiment, the thickness t of the PCD table 102 may be entirely encompassed by the depth d defining the second region 112, the infiltration distance h defining the first region 110 and the segregation distance g defining the third region 113. In an embodiment, the depth d and the infiltration depth h may overlap, in such an embodiment, the segregation distance g may define the region of overlap between the depth d and the infiltration depth h.

The third region 113 may be a leached region, wherein only a residual amount of metal-solvent catalyst and/or infiltrant materials remain. In an embodiment, the third region 113 may contain more than a residual amount of metal-solvent catalyst and/or infiltrant materials therein. For example, the third region 113 may comprise substantially all of the metal-solvent catalyst infiltrated into the PCD table during the first HPHT process therein.

In an embodiment, after bonding the PDC table 102 to the substrate 108 and infiltrating the PCD table with at least one of a first infiltrant and a second infiltrant, for example during a second HPHT process, the first region 110 may include a first infiltrant therein and/or the second region 112 may include a second infiltrant therein. The first and second infiltrants may comprise any of the infiltrants described herein. For example, the first infiltrant may comprise cobalt and silicon, and the second infiltrant may comprise copper, copper and aluminum, or aluminum. In an embodiment, the first and/or second infiltrants may subsequently be at least partially leached from the resulting infiltrated PCD table.

In an embodiment, the at least partially leached PCD table having a first and second infiltrant therein, substantially as depicted in FIG. 1E, may have a third region 113 between the first region 110 and the second region 112. The third region 113 may be substantially free of the first infiltrant and the second infiltrant. In an embodiment, the third region may comprise a mixture or alloy of the first infiltrant and the second infiltrant (i.e., when the first region and the second region overlap). For example, the third region may comprise a gradient including more of the first infiltrant nearer the first region 110 gradually changing composition to contain more of the second infiltrant nearer the second region 112. In another embodiment, the third region 113 may comprise a substantially consistent mixture or alloy of the first and second infiltrants throughout the third region 113. In an embodiment, the PCD table 102 may not include a third region 113, whereby the first region 110 and the second region 112 are infiltrated with a first and second infiltrant respectively that meet at an interface therebetween. The interface may be planar or substantially similar to the nonplanar interface 114 depicted in and described in relation to FIG. 1C.

In an embodiment, the first and second infiltrants may infiltrate the leached PCD table 102 inwardly from the back surface 111 and the working surface 106 respectively. The resulting infiltrated PCD table 102 may have a first region 110 and a second region 112 including the first infiltrant and the second infiltrant therein respectively. In an embodiment, the first infiltrant and the second infiltrant may infiltrate substantially the entirety of the thickness t of the PCD table 102 such that there is only a single region comprising both the first region 110 and second region 112 wherein the first infiltrant and the second infiltrant are distributed throughout the single region (e.g., regions 110 and 112 entirely overlap each other). In an embodiment, the first and second infiltrants may alloy within the single region to comprise a substantially homogenous composition of the first and second infiltrants throughout the single region. In another embodiment, the single region may comprise a gradient including more of the first infiltrant nearer the interfacial surface 109 gradually changing composition to contain more of the second infiltrant nearer working surface 106. The single region as describe above may be referred to as either of the first region 110 or the second region 112. For example, when the first infiltrant includes a cobalt-silicon alloy provided from the substrate 108 and the second infiltrant includes copper and optionally aluminum, at least a portion of the interstitial regions of the PCD table 102 may be at least partially filled with an alloy comprising cobalt, silicon, copper, and optionally aluminum.

In an embodiment, only one of the first infiltrant and the second infiltrant may infiltrate substantially all of the thickness t of the PCD table 102, wherein the remaining infiltrant of the first and second infiltrants only partially infiltrates the PCD table (i.e., to some intermediate depth). In such and embodiment, if the first infiltrant infiltrates substantially all of the thickness of the PCD table, the second region 112 may comprise both the first and second infiltrant and the first region may only comprise the first infiltrant. If the second infiltrant infiltrates substantially all of the thickness t of the PCD table, then the first region 110 may comprise both the first and second infiltrants, and the second region may only comprise the second infiltrant.

Figure 2:
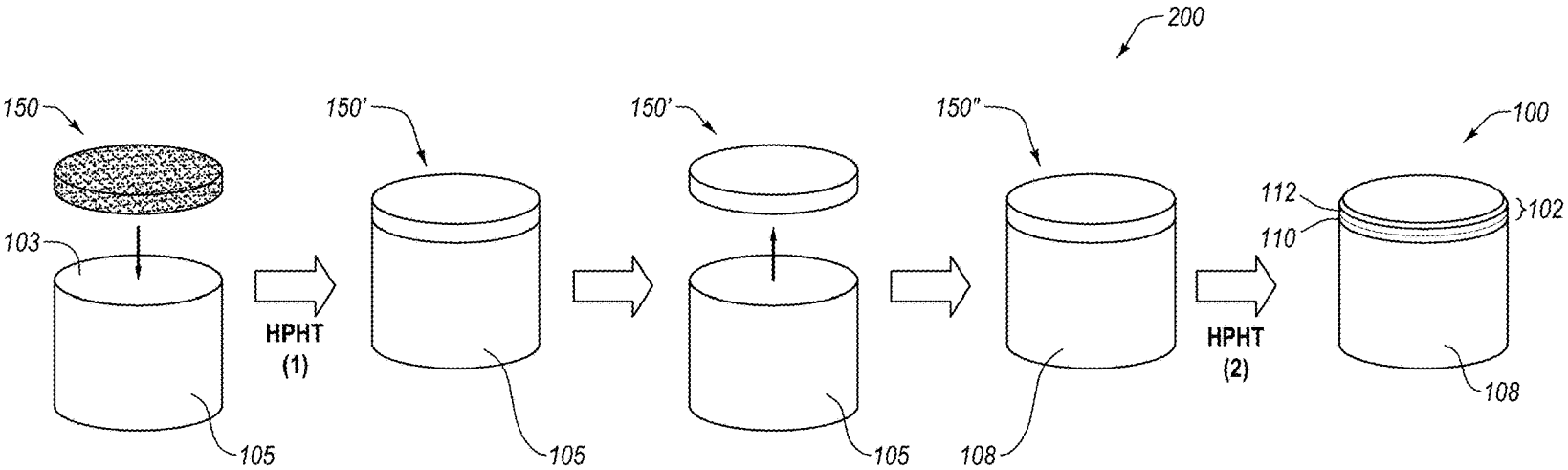
FIG. 2 is a schematic illustration of an embodiment of a method for fabricating the PDCs shown in FIGS. 1A-1C.

FIG. 2 is a schematic illustration of an embodiment of a method for fabricating the PDC 100 shown in FIG. 1. The plurality of diamond particles of the one or more layers of diamond particles 150 may be positioned adjacent to an interfacial surface 103 of a first cemented carbide substrate 105.

The diamond particle size distribution of the plurality of diamond particles may exhibit a single mode, or may be a bimodal or greater grain size distribution. In an embodiment, the diamond particles of the one or more layers of diamond particles may comprise a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger average particle size (e.g., 50 μm, 40 μm, 30 μm, 20 μm, 15 μm, 12 μm, 10 μm, 8 μm) and another portion exhibiting at least one relatively smaller average particle size (e.g., 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger average particle size between about 10 μm and about 40 μm and another portion exhibiting a relatively smaller average particle size between about 1 μm and 4 μm. In some embodiments, the diamond particles may comprise three or more different average particle sizes (e.g., one relatively larger average particle size and two or more relatively smaller average particle sizes), without limitation.

The first cemented carbide substrate 105 and the one or more layers of diamond particles 150 having different average particle sizes may be placed in a pressure transmitting medium, such as a refractory metal can embedded in pyrophyllite or other pressure transmitting medium. The pressure transmitting medium, including the first cemented carbide substrate 105 and the one or more layers of diamond particles 150 therein, may be subjected to a first HPHT process using an ultra-high pressure cubic press to create temperature and pressure conditions at which diamond is stable. The temperature of the first HPHT process may be at least about 1000° C. (e.g., about 1200° C. to about 1600° C.) and the pressure of the first HPHT process may be at least about 5.0 GPa cell pressure (e.g., at least about 6 GPa, at least about 7.5 GPa, about 7.5 GPa to about 12.0 GPa cell pressure, about 7.5 GPa to about 9.0 GPa cell pressure, or about 8.0 GPa to about 10.0 GPa cell pressure, about 5 GPa to about 6 GPa) for a time sufficient to sinter the diamond particles 150 to form the PCD table 150'. In some embodiments, one or more transition layers may be disposed between the first cemented carbide substrate 105 and the diamond particles 150 as disclosed in U.S. application Ser. No. 13/087,775, the disclosure of which is incorporated herein, in its entirety, by this reference.

During the first HPHT process, the metal-solvent catalyst cementing constituent (e.g., cobalt) from the first cemented carbide substrate 105 may be liquefied and may infiltrate into the diamond particles of the one or more layers of diamond particles 150. The infiltrated metal-solvent catalyst cementing constituent functions as a catalyst that catalyzes initial formation of directly bonded-together diamond grains to form the PCD table 150'.

In an alternative to using the first cemented carbide substrate 105 during sintering of the diamond particles, the PCD table 150' may be formed by placing the diamond particles along with a metal-solvent catalyst (e.g., cobalt powder and/or a cobalt disc) in a pressure transmitting medium, such as a refractory metal can embedded in pyrophyllite or other pressure transmitting medium. The pressure transmitting medium, including the diamond particles and metal-solvent catalyst therein, may be subjected to a first HPHT process using an ultra-high pressure press to create temperature and pressure conditions at which diamond is stable. Such a process will result in the formation of a PCD table 150' separate from any cemented carbide substrate 105.

In embodiments in which the PCD table 150' is formed so as to be metallurgically bonded to a cemented carbide substrate, the PCD table 150' may then be separated from the first cemented carbide substrate 105, as shown in FIG. 2. For example, the PCD table 150' may be separated from the first cemented carbide substrate 105 by grinding and/or lapping away the first cemented carbide substrate 105, electro-discharge machining, laser cutting, or combinations of the foregoing material removal processes.

When the HPHT sintering pressure is greater than about 7.5 GPa cell pressure, optionally in combination with the average diamond particle size being less than 30 μm, the PCD table 150' (prior to being leached) defined collectively by the bonded diamond grains and the metal-solvent catalyst may exhibit a coercivity of about 115 Oe or more and a metal-solvent catalyst content of less than about 7.5% by weight as indicated by a specific magnetic saturation of about 15 $G{\cdot}cm^3/g$ or less. In another embodiment, the coercivity may be about 115 Oe to about 250 Oe and the specific magnetic saturation of the PCD table 150' (prior to being leached) may be greater than 0 $G{\cdot}cm^3/g$ to about 15 $G{\cdot}cm^3/g$. In another embodiment, the coercivity may be about 115 Oe to about 175 Oe and the specific magnetic saturation of the PCD may be about 5 $G{\cdot}cm^3/g$ to about 15 $G{\cdot}cm^3/g$. In yet another embodiment, the coercivity of the PCD table 150' (prior to being leached) may be about 155 Oe to about 175 Oe and the specific magnetic saturation of the first region 114 may be about 10 $G{\cdot}cm^3/g$ to about 15 $G{\cdot}cm^3/g$. The specific permeability (i.e., the ratio of specific magnetic saturation to coercivity) of the PCD may be about 0.10 $G{\cdot}cm^3/g{\cdot}Oe$ or less, such as about 0.060 $G{\cdot}cm^3/g{\cdot}Oe$ to about 0.090 $G{\cdot}cm^3/g{\cdot}Oe$. In some embodiments, the average grain size of the bonded diamond grains may be less than about 30 μm and the metal-solvent catalyst content in the PCD table 150' (prior to being leached) may be less than about 7.5% by weight (e.g., about 1% to about 6% by weight, about 3% to about 6% by weight, or about 1% to about 3% by weight).

The specific magnetic saturation and the coercivity of the PCD table 150' may be tested by a number of different techniques to determine the specific magnetic saturation and coercivity. As merely one example, ASTM B886-03 (2008) provides a suitable standard for measuring the specific magnetic saturation and ASTM B887-03 (2008) e1 provides a suitable standard for measuring the coercivity of the sample region. Although both ASTM B886-03 (2008) and ASTM B887-03 (2008) e1 are directed to standards for measuring magnetic properties of cemented carbide materials, either standard may be used to determine the magnetic properties of PCD. A KOERZIMAT CS 1.096 instrument (commercially available from Foerster Instruments of Pittsburgh, Pa.) is one suitable instrument that may be used to measure the specific magnetic saturation and the coercivity of the sample region based on the foregoing ASTM standards. Additional details about the magnetic properties of PCD tables formed at a cell pressure greater than about 7.5 GPa and magnetic testing techniques can be found in U.S. Pat. No. 7,866,418, which was previously incorporated by reference.

When the first HPHT process sintering pressure is about 5 GPa to about 6 GPa cell pressure, optionally in combination with the average diamond particle size being less than about 30 μm, the PCD table 150' (prior to being leached) defined collectively by the bonded diamond grains may exhibit larger average porosity in the interstitial regions or more connected interstitial regions than a PCD table sintered at higher pressures, such as those described above (e.g., sintering pressures of 7.5 GPa and above). Infiltration of such a PCD table may occur more readily than with PCD tables exhibiting smaller pore sizes. Further, leaching may penetrate deeper and/or more completely into the interstitial regions of such a PCD table from the surface thereof. Subsequent infiltration of a leached PCD table (e.g., by a first and/or second infiltrant such as cobalt from a cobalt-cemented tungsten-carbide substrate) may occur more readily than in PCD tables exhibiting smaller average porosity or connectivity. However, a PCD table or region of a PCD table that has not been thoroughly leached (e.g., a PCD table or region of a PCD table having about 1.2% metal-solvent catalyst therein or more) may not be infiltrated as completely as a PCD table that has been leached more thoroughly (i.e., a PCD table having about 1.0% by weight or less metal-solvent catalyst therein).

Whether the first cemented carbide substrate 105 is employed during formation of the PCD table 150' or not, the metal-solvent catalyst may be at least partially removed from the PCD table 150' by immersing the PCD table 150' in aqua regia, nitric acid, hydrofluoric acid, mixtures thereof, or other suitable acid, to form a porous at least partially leached PCD table 150" that allows fluid to flow therethrough (e.g., from one side to another side). For example, the PCD table 150' may be immersed in the acid for about 2 to about 7 days (e.g., about 3, 4, 5, 6, or 7 days) or for many weeks (e.g., about 4-10 weeks) depending on the process employed. In some embodiments, a residual amount of the metal-solvent catalyst used to catalyze formation of the diamond-to-diamond bonds of the PCD table 150' may still remain even after leaching. For example, the residual metal-solvent catalyst in the interstitial regions may be about 0.5% to about 2% by weight, such as about 0.9% to about 1% by weight, or as previously disclosed herein. In less thorough leaching processes, the residual amount of metal-solvent catalyst in the interstitial regions may be greater than about 1% by weight, such as greater than about 1% by weight to about 2% by weight, about 1.1% by weight to about 1.5% by weight, about 1.2% by weight, or greater than about 1.2% by weight. PCD tables formed at relatively lower pressures during HPHT sintering (e.g., about 5 GPa to about 6 GPa) including more than about 1.1% by weight of cobalt in the interstitial regions therein after leaching may demonstrate increased delamination from substrates after HPHT bonding. It is currently believed that amounts of metal-solvent catalyst, present in the PCD after leaching, of more than about 1.1% by weight, prevents/inhibits subsequent infiltration of infiltrant (i.e., from a substrate) during bonding, and therefore may lead to increased delamination. Even small increases such as 0.1% by weight more (e.g., 1.2% by weight of solvent metal catalyst) may result in an increase in delamination.

In embodiments employing the cemented carbide substrate 105, it is noted that because the metal-solvent catalyst is infiltrated into the diamond particles from the cemented carbide substrate 105 including tungsten carbide or other carbide grains cemented with a metal-solvent catalyst (e.g., cobalt, nickel, iron, or alloys thereof), the infiltrated metal-solvent catalyst may carry tungsten therewith, tungsten carbide therewith, another metal therewith, another metal carbide therewith, or combinations of the foregoing. In such embodiments, the PCD table 150' and the at least partially leached PCD table 150" may include such material(s) disposed interstitially between the bonded diamond grains. The tungsten therewith, tungsten carbide therewith, another metal therewith, another metal carbide therewith, or combinations of the foregoing may be at least partially removed by the selected leaching process or may be relatively unaffected by the selected leaching process.

As shown in FIG. 2, the at least partially leached PCD table 150" may be placed with the cemented carbide substrate 108 to which the at least partially leached PCD table 150" is to be attached to form an assembly 200. The assembly 200 may be placed in a pressure transmitting medium, such as a refractory metal can embedded in pyrophyllite or other pressure transmitting medium. The pressure transmitting medium, including the assembly 200, may be subjected to a second HPHT process using an ultra-high pressure cubic press to create temperature and pressure conditions at which diamond is stable. The temperature of the second HPHT process may be at least about 1000° C. (e.g., about 1200° C. to about 1600° C.) and the pressure of the second HPHT process may be at least 5.0 GPa cell pressure (e.g., about 5.0 GPa to about 12.0 GPa cell pressure). In some embodiments, the pressure of the second HPHT process may be less than that used in the first HPHT process, such as less than about 6 GPa, to limit damage (e.g., cracking) to the at least partially leached PCD table 150". During the second HPHT process, the first infiltrant comprises a cobalt-based alloy first infiltrant exhibiting eutectic characteristics so that the viscosity of the cobalt-based and/or nickel-based alloy first infiltrant is less than would be exhibited were cobalt and/or nickel used alone. The cobalt-based and/or nickel-based alloy first infiltrant provided from the cemented carbide substrate 108 or provided from a separate structure (e.g., inserted between the substrate 108 and the PCD table 150") is liquefied and infiltrates into the at least partially leached PCD table 150". During the same HPHT process, the PCD table 102 may also be infiltrated with the second infiltrant. During and/or upon cooling from the second HPHT process, the infiltrated at least partially leached PCD table 150" is bonded to the cemented carbide substrate 108.

As mentioned, as an alternative to using the cemented carbide substrate 108 as an infiltrant source, an infiltrant layer (e.g., a cobalt-based and/or nickel-based alloy first infiltrant foil, disc or generally conical or generally cylindrical member) may be disposed between the cemented carbide substrate 108 and the PCD table 150". A second infiltrant foil, disc or other member may also be disposed between the substrate 108 and the PCD table 150". Alternatively, one or more of such infiltrant foils, powder, discs, or other members may be disposed above the PCD table 150". In such an embodiment, the first infiltrant layer may liquefy and infiltrate into the PCD table 150" during the second HPHT process. Such foil, disc and generally conical members are described in more detail in conjunction with FIGS. 3A-3D.

Second Infiltrants

In some embodiments, the first and second infiltrants and/or the alloy of the first and second infiltrants that occupy the at least a portion of the interstitial regions of PCD table 102 may be at least partially removed in a subsequent leaching process using an acid, such as aqua regia, nitric acid, hydrofluoric acid, mixtures thereof, or other suitable acid. Because the second infiltrant and/or an alloy including the second infiltrant and/or components thereof is present interstitially in the PCD table 102, removal of the infiltrants and/or the alloy of the infiltrants is actually more easily accomplished than were the second infiltrant not included. In other words, the second infiltrant is specifically selected to exhibit relatively low viscosity while also being relatively easily leached or otherwise removed from the PCD table 102. Examples of a second infiltrant that facilitate faster, more complete leaching include, but are not limited to copper, tin, germanium, gadolinium, magnesium, lithium, silver, zinc, gallium, antimony, bismuth, cupro-nickel, aluminum, mixtures thereof, alloys thereof, and combinations thereof. Various cupro-nickel alloys may be suitable for use which may contain varying fractions of copper and nickel. An example cupro-nickel alloy may include about 70% by weight copper to about 90% by weight copper, and about 10% by weight nickel to about 30% by weight nickel (e.g., about 75% by weight copper and about 25% by weight nickel). Other minor alloying elements (e.g., iron, manganese) may also be present in the cupro-nickel alloy. Such second infiltrants may be present in elemental form, or may be present as a desired compound or alloy. The second infiltrant may include materials imparting improved wear resistance and/or thermal stability to a PCD table comprising the second infiltrant. For example, a copper-containing second infiltrant, having a relatively low melting temperature, such as about 1085° C. or less, may extrude through the interstitial spaces between the diamond grains before expanding in the PCD table and causing a fracture under elevated temperatures (such as during cutting operations), as disclosed in U.S. patent application Ser. No. 13/027,954 and Ser. No. 13/690,397, the entirety of which are incorporated herein by this reference. Such second infiltrant materials imparting improved wear resistance may include, copper, tin, aluminum, manganese, alloys of the foregoing, and combinations of the foregoing. For example, a copper-aluminum alloy has been found to improve the wear resistance of a PCD table sintered at a sintering temperature of about 6 GPa. The second infiltrant may have a melting temperature or liquidus temperature of less than about 1300° C. In addition, the second infiltrant exhibits relatively faster and/or more complete leaching or other removal characteristics as compared to a pure cobalt or nickel infiltrant. For example, melting temperatures at standard pressure conditions for non-limiting embodiments of the second infiltrants are shown below in Table 1.

TABLE 1

| Second Infiltrant | Melting Temperature (° C.) |
|---|---|
| Magnesium | 650 |
| Lithium | 181 |
| Tin | 232 |
| Silver | 962 |
| Copper | 1085 |
| Zinc | 420 |
| Germanium | 938 |
| Gallium | 30 |
| Antimony | 631 |
| Bismuth | 271 |
| Gadolinium | 1313 |
| Cupro-Nickel | ~1170-1240* |
| Aluminum | 660 |

*Depending on specific compositional characteristics.

In another embodiment, any of the above described first infiltrants may be employed as a second infiltrant, as the first infiltrants exhibit liquidus temperatures that are lower than the melting temperature of cobalt used alone (1495° C.) or nickel used alone (1455° C.), as the case may be. For example, where a cobalt-based alloy infiltrant (as either a first or second infiltrant) is employed, it will exhibit a liquidus temperature that is less than 1495° C. Similarly, where a nickel-based alloy infiltrant (as either a first or second infiltrant) is employed, it will exhibit a liquidus temperature that is less than 1455° C. For example, a nickel-based first infiltrant and a cobalt-based second infiltrant may be employed, or vice versa. In another embodiment, both first and second infiltrants may be cobalt-based or nickel-based, but may include differing eutectic forming constituents and/or concentrations thereof. That said, in an embodiment, the second infiltrant may not be cobalt-based or nickel-based, but may include an element or alloy (e.g., such as those listed above in Table 1) that exhibit relatively faster and/or more complete leaching characteristics as compared to cobalt and nickel infiltrants.

As described above, in some embodiments, infiltration may be carried out so that only partial infiltration of infiltrants occurs through the PCD table 102 (e.g., to result in a second region 112 that may already be substantially free of infiltrants). Even though the second region 112 may already be substantially free of one or both infiltrants, the inventors have found that leaching may improve the uniformity and/or position of the interface 114 (see FIG. 1C) between the first and second regions 110 and 112 respectively, which may improve thermal stability and/or wear resistance in the finished PDC 100. In addition, infiltration may be carried out in a manner whereby one of the infiltrants (e.g., the first infiltrant) is only partially infiltrated into the PCD table 102, while the other infiltrant (e.g., the second infiltrant) may be fully infiltrated throughout the entire thickness of PCD table 102. In another embodiment, one infiltrant (e.g., the first infiltrant) may be only partially infiltrated into the PCD table 102 from below, while the other infiltrant (e.g., the second infiltrant) may be infiltrated into the PCD table 102 from above, possibly resulting in a region 112 which may be substantially free of the first infiltrant, but which may include the second infiltrant. In other embodiments, the first infiltrant, second infiltrant, or both may be partially or fully infiltrated through the PCD table 102, as desired. Such various infiltration schemes will be described in further detail below in conjunction with FIGS. 3A-3E.

Figure 3A:
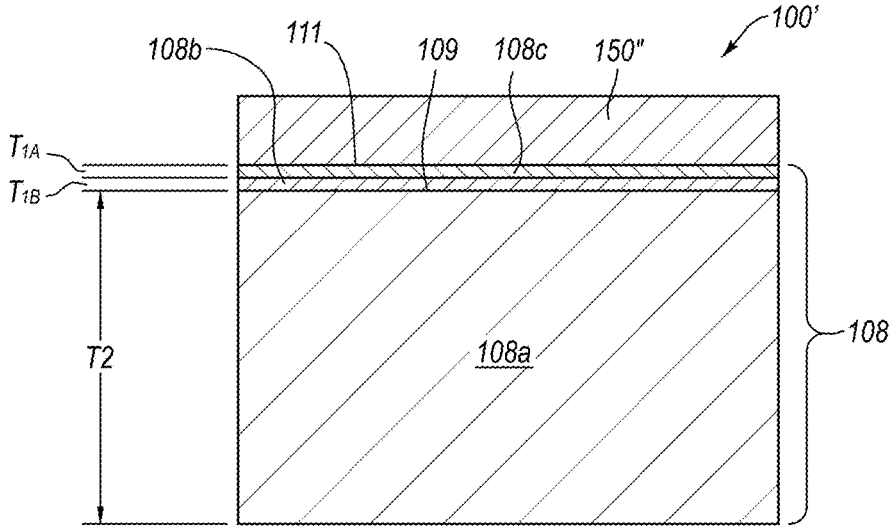
FIG. 3A is a cross-sectional schematic view of an embodiment of an assembly for forming a PDC, including placement of disc or foil inserts between the PCD table and the substrate, which provide the first and second infiltrants during HPHT processing.

FIG. 3A is a cross-sectional view through a PDC assembly 100' prior to HPHT processing to form the PDC 100 as seen in FIG. 1A. As described above, the first infiltrant may be provided from various sources, such as from the substrate (e.g., substrate 108 may be cemented with the first infiltrant). In other embodiments, as shown in FIGS. 3A-3D, the first and second infiltrants may be provided by structures (e.g., a foil, a disc, a conical insert, etc.) positioned to provide an infiltrant during HPHT processing. FIG. 3A shows use of disc shaped members 108*b* and 108*c* for providing the first infiltrant and second infiltrant, respectively. For example, the disc shaped member (e.g., a metal foil) 108*b* may be a cobalt-based or nickel-based alloy including at least one eutectic forming constituent. The disc shaped member (e.g., a metal foil) 108*c* may be copper, tin, zinc, magnesium, boron, silver, germanium, gallium, alloys of one or more of the foregoing metals, or any other of the materials identified in Table 1 or elsewhere as a suitable second infiltrant that will result in faster and/or more complete leaching of the resulting mixture of first and second infiltrants from the PCD table 102 after HPHT processing and/or increased wear resistance of the resulting infiltrated PCD table 102. During HPHT processing, the first and second infiltrants sweep up into the at least partially leached PCD table 150" during attachment of the at least partially leached PCD table 150" to the cemented carbide substrate 108. In such embodiments, the cemented carbide substrate 108 may be considered to also include both disc portions 108*b*, 108*c*, and adjacent substrate portion 108*a*. In some embodiments, disc portions 108*b*, 108*c* are so thin and comprised of substantially only the infiltrants so that after the second HPHT process, the disc structure or foil is not readily recognizable, as the infiltrant material of the discs has been melted and/or swept into the at least partially leached PCD table 150".

In an embodiment, disc portions 108*b* may exhibit any of the compositions discussed herein for the cemented carbide substrate 108 shown in FIGS. 1A-2 (e.g., a carbide substrate cemented with the first infiltrant) or the first infiltrant. While FIG. 3A shows placement of first infiltrant disc portion 108*b* adjacent to substrate portion 108*a* (i.e., with second infiltrant disc portion 108*c* on "top" and first infiltrant disc portion 108*b* on "bottom"), it will be understood that the relationship may be reversed.

In FIGS. 3A-3C and 3E, the interfacial surface 109 is illustrated as substantially planar. However, in other embodiments, the interfacial surface 109 may exhibit a nonplanar topography, such as a domed geometry (e.g., a hemispherical geometry). For example, the interfacial surface 109 may exhibit a domed portion (e.g., a substantially complete or truncated hemispherical portion) that extends over substantially all of the interfacial surface 109 and has a radius of curvature of about 0.50 inch to about 1.20 inch (e.g., about 0.60 inch to about 1.00 inch) and a thickness of about 0.030 inch to about 0.100 inch (e.g., about 0.035 inch to about 0.050 inch). The at least partially leached PCD table 150" may exhibit a complementary configured recess that is configured to receive the domed portion along with the substrate portions 108*b* and 108*c* being configured to generally correspond to and conform to the geometry of the domed region.

In any case, during the second HPHT process, the first infiltrant from the disc 108*b* may liquefy and sweep into the PCD table 102, metallurgically bonding the substrate portion 108*a* and the at least partially leached PCD table 150" together while second infiltrant from disc 108*c* also liquefies and sweeps into the at least partially leached PCD table 150", occupying interstitial regions between diamond grains with the first infiltrant. It should be noted that depending on the amount of the first and second infiltrants and the geometry of the at least partially leached PCD table 150", a third infiltrant from the substrate portion 108*a* (e.g., cobalt from a cobalt-cemented tungsten carbide substrate) may also infiltrate into the at least partially leached PCD table 150" (e.g., before or after the first and second infiltrants, depending on the melting point of such infiltrants). As such, after HPHT processing, the interstitial regions between diamond grains of the at least partially leached PCD table 150" may be occupied with an alloy of the first and second infiltrants. In an embodiment, the first infiltrant may be provided directly from the substrate 108, and/or from the substrate portion 108*a*, 108*d*, or 108*e*. In such an embodiment, the second infiltrant may be provided from a disc, foil, or powder substantially as described above. In an embodiment, the second infiltrant may infiltrate the PCD table 102 from the working surface 106 inward. The presence of the second infiltrant component(s) (e.g., copper) in the alloy interstitially present in the PCD table 102 facilitates relatively faster and/or more complete removal of the infiltrants from at least a region of the PCD table 102 through subsequent leaching. The presence of the second infiltrant component(s) (e.g., copper and/or aluminum) in the interstitial spaces, interstitially present in the PCD table 102 may also impart improved wear resistance and/or thermal stability to the PCD table 102. After processing, the cross-section of the resulting PDC may appear similar to the embodiments of FIG. 1B or 1C, without any distinct intermediate portion 108*b*.

The disc portions 108*b* and 108*c* may exhibit a thickness $T_{1A}$ and $T_{1B}$ of about 0.0010 inch to about 0.100 inch, such as about 0.0020 inch to about 0.030 inch, or about 0.001 inch to about 0.005 inch. The adjacent substrate portion 108*a* may exhibit a thickness T2 that will be dependent on the configuration of the desired PDC, for example between about 0.20 inch and about 0.60 inch.

Figure 3B:
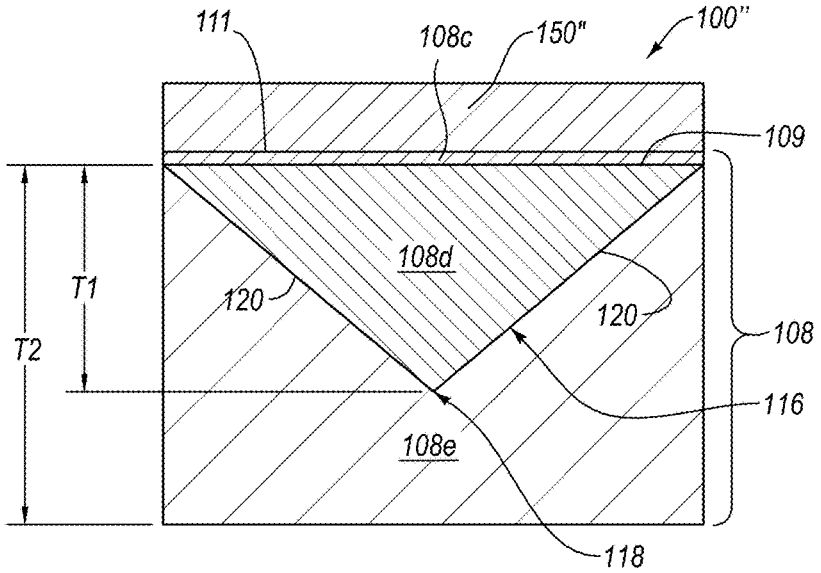
FIG. 3B is a cross-sectional schematic view of an embodiment of an assembly for forming a PDC including a placement of a generally conical insert between the PCD table and the substrate that provides one or more infiltrants during HPHT processing.

FIG. 3B is a cross-sectional view through another PDC assembly 100" prior to HPHT processing, similar to PDC assembly 100' of FIG. 3A, but in which the member providing the cobalt-based or nickel-based alloy first infiltrant is configured differently. In the interest of brevity, only the differences between the PDC assembly 100" and the PDC 100' are described in detail below. The carbide substrate 108 includes a first substrate portion 108*d* having an interfacial surface 109 adjacent second infiltrant 108*c* and which becomes bonded to the at least partially leached PCD table 150" and a second substrate portion 108*e* that becomes bonded to the first substrate portion 108*d*. With regard to the first substrate portion 108*d* shown in FIG. 3B, the first substrate portion 108*d* may exhibit any of the compositions discussed herein for the cemented carbide substrate 108 shown in FIGS. 1A-2. The second substrate portion 108*e* comprises a cemented carbide material (e.g., cobalt and/or nickel-cemented tungsten and/or tantalum carbide) that may be chosen to be more wear resistant or erosion resistant than that of the first substrate portion 108*d*, which it protects. For example, the second substrate portion 108*e* may exhibit a composition of about 10 to about 15% by weight cobalt and/or nickel (e.g., about 13% cobalt and/or nickel by weight), with the balance being tungsten carbide, tantalum carbide, chromium carbide, or combinations thereof. For example, one suitable composition for the substrate portion 108*e* is disclosed in U.S. Application No. 61/768,812, the disclosure of which is incorporated herein, in its entirety, by this reference.

In the illustrated embodiment, the first substrate portion 108*d* may exhibit a generally conical geometry having a generally triangular cross-sectional as shown. The first substrate portion 108*d* is received in a recess 116 formed in the second substrate portion 108*e*. The first substrate portion 108*d* extends from the interfacial surface 109 to an apex 118 to define a thickness T1, which may be about 0.050 inch to about 0.150 inch, such as about 0.075 inch to about 0.100 inch. A thickness T2 of the second substrate portion 108*e* may be about 0.30 inch to about 0.60 inch. The second substrate portion 108*e* substantially surrounds and is bonded to a lateral periphery 120 of the first substrate portion 108*d* to define an interface that may be observable in, for example, an SEM after HPHT processing. During the second HPHT process, some of the cobalt-based and/or nickel-based alloy first infiltrant of the first substrate portion 108*d* is swept into the at least partially leached PCD table 150", metallurgically bonding the at least partially leached PCD table 150" to the first substrate portion 108*d* and the second substrate portion 108*e* to the first substrate portion 108*d*.

Also during HPHT processing, the second infiltrant from the disc portion or foil 108*c* is swept into the at least partially leached PCD table 150" with the first infiltrant, occupying at least a portion of the interstitial regions of the at least partially leached PCD table 150", as described above in conjunction with FIG. 3A. The presence of the second infiltrant component(s) (e.g., copper and/or aluminum) in the alloy interstitially present within the PCD table 102 facilitates relatively faster and/or more complete removal of the infiltrants from at least a region of the PCD table 102 through subsequent leaching and/or imparts improved wear resistance and/or thermal stability to the resulting infiltrated PCD table 102.

Figure 3C:
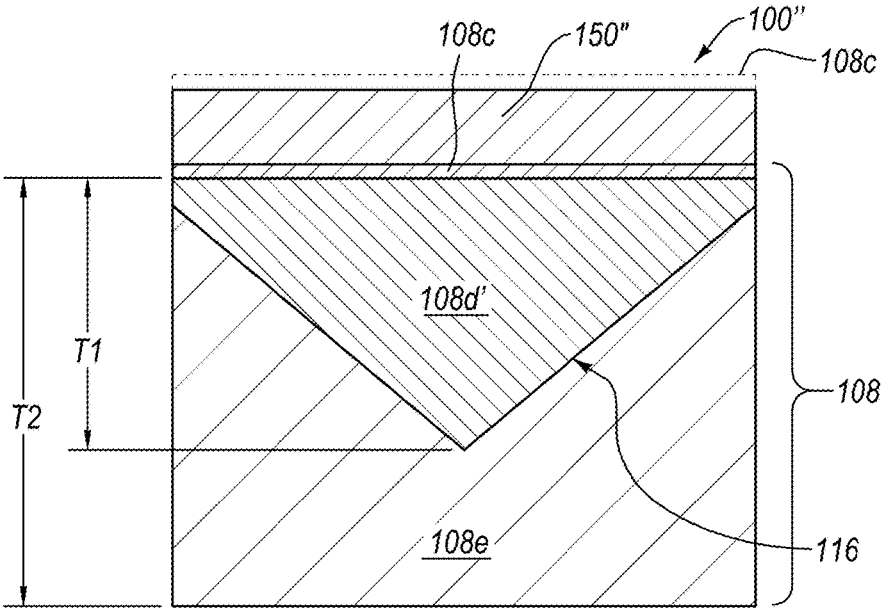
FIG. 3C is a cross-sectional schematic view of an embodiment of an assembly for forming a PDC including placement of another configuration of a generally conical insert between the PCD table and the substrate in which the insert provides one or more infiltrants during HPHT processing.

The first substrate portion 108*d* may exhibit other configurations than that shown in FIG. 3B. For example, FIG. 3C is a cross-sectional view of another PDC assembly 100" similar to that of FIG. 3B, but in which the "top" portion of first substrate portion 108*d'* includes a portion that forms the exterior peripheral surface of substrate 108. The disc or foil 108*c* may be placed on top of the at least partially leached PCD table 150", between the at least partially leached PCD table 150" and the substrate portion 108*d'*, or both on top of the at least partially leached PCD table 150" and between the at least partially leached PCD table 150" in different embodiments. The geometry of substrate portions 108*d'* may be considered to include a conical lower portion similar to conical substrate portion 108*d* of FIG. 3B in combination with a disc shaped substrate portion 108*b* of FIG. 3A. The disc portion at the top of substrate portion 108*d'* (e.g., analogous to disc substrate portion 108*b*) extends above the recess 116 of the second substrate portion 108*e* and becomes bonded to the PCD table 102. FIGS. 3A-3C illustrate example geometries for first and second substrate portions. Other complementary geometries may also be employed.

Figure 3D:
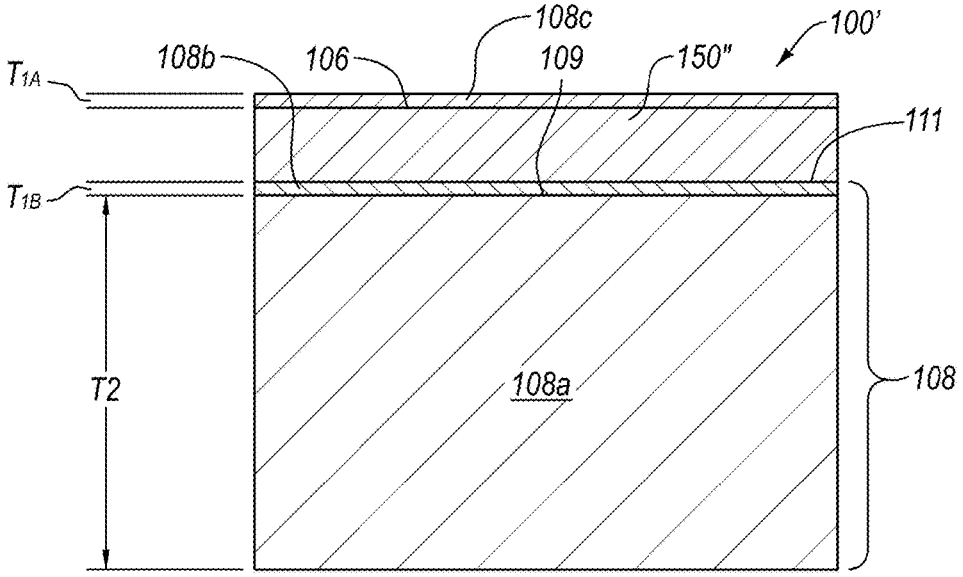
FIG. 3D is a cross-sectional schematic view of another embodiment of an assembly for forming a PDC including placement of an insert between the PCD table and the substrate and another disc or foil above the PCD table, which provide the first and second infiltrants during HPHT processing.

FIG. 3D shows another embodiment in which one of the disc members is placed atop the at least partially leached PCD table 150", rather than placing both disc members 108*b* and 108*c* below the at least partially leached PCD table 150". For example, the disc member or foil 108*c* comprising the second infiltrant (e.g., copper) may be positioned above the PCD table 102, while the disc member or foil 108*b* comprising the first infiltrant is positioned below the at least partially leached PCD table 150", between the at least partially leached PCD table 150" and substrate portion 108*a*. A powder mixture and/or layer(s) of powders may also be used as a second infiltrant source in a manner similar to that described above regarding disc member of foil 108*c*. It will be understood that any of the other illustrated embodiments, such as FIGS. 3B and 3C may be similarly modified by placing the disc member 108*c* comprising the second infiltrant above the at least partially leached PCD table 150". It should be noted that depending on the amount of the first and second infiltrants and the geometry of the at least partially leached PCD table 150", a third infiltrant from the substrate portion 108*a* (e.g., cobalt from a cobalt-cemented tungsten carbide substrate) may also infiltrate into the at least partially leached PCD table 150" (e.g., before or after the first and second infiltrants, depending on the melting point of all such infiltrants).

Figure 3E:
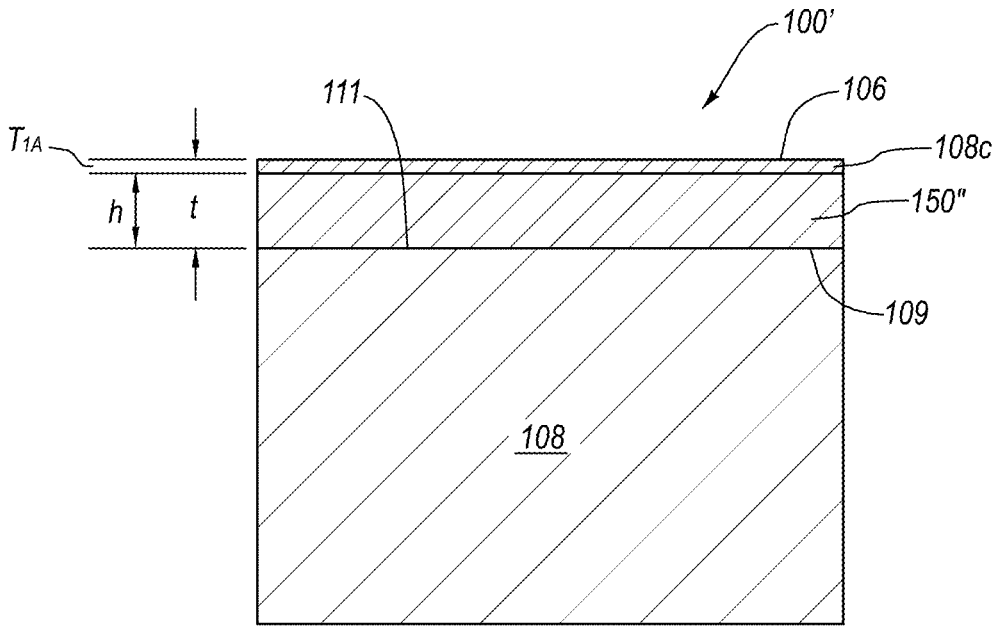
FIG. 3E is a cross-sectional schematic view of another embodiment of an assembly for forming a PDC including placement of a PCD table on a substrate and an insert above the PCD table, which provide the first and second infiltrants during HPHT processing.

FIG. 3E illustrates an embodiment where a disc member or foil 108*c*, including a second infiltrant therein, is placed on top the at least partially leached PCD table 150", and the PCD table 150" is placed directly onto a substrate 108, wherein the first infiltrant is provided by and incorporated into the substrate 108 prior to HPHT bonding. The substrate 108 may comprise any of the infiltrants described herein. The second infiltrant disc or foil 108*c* may exhibit a thickness $T_{1A}$. The first infiltrant may be a low viscosity cobalt-silicon alloy included in a cobalt-cemented tungsten carbide substrate to improve penetration of the first infiltrant into the interstitial regions of the PCD table from the back surface thereof. In an embodiment, the second infiltrant may comprise at least a single disc or foil of about 0.001 inches thick to about 0.01 inches thick such as about 0.001 to about 0.003 inches thick, about 0.003 to about 0.006 inches thick, about 0.007 to about 0.01 inches thick, about 0.005 inches thick or less, such as about 0.003 inches thick, about 0.002 inches thick, or about 0.001 inches thick. After second HPHT processing, which may include any second HPHT process described herein in which the cell pressure is lower than the first HPHT process cell pressure (e.g., about 5 GPa or about 6 GPa), the resulting PCD table 102 comprises a residual amount of metal-solvent catalyst, a first infiltrant, and a second infiltrant. The resulting bonded and infiltrated PCD table 102 may resemble FIG. 1E. The first infiltrant may infiltrate into the PCD table 150" from the interfacial surface 109 of the substrate 108 inward to an infiltration distance h. The second infiltrant may infiltrate into the PCD table 150" from the disc member or foil 108*c* at the working surface 106 inward to a depth d. The resulting PCD table 102 may be at least partially leached to remove at least a portion of the first and/or second infiltrant from a selected depth therein, such as any of leaching depths described herein. The resulting infiltrated and at least partially leached PCD table 102 may include at least a residual amount of metal-solvent catalyst, first infiltrant, second infiltrant, or combinations of the foregoing in any region therein.

In embodiments, the infiltration distance h, and/or the depth d may include all of the thickness t of the PCD table 150", about three quarters of the thickness t of the PCD table 150", about half of the thickness t of the PCD table 150", one third of the thickness t of the PCD table 150", or about one quarter of the thickness t of the PCD table.

In an embodiment, the first infiltrant and the second infiltrant may infiltrate substantially the entirety of the thickness t of the PCD table 150" such that there is only a single region comprising the first infiltrant and the second infiltrant are distributed throughout the single region. In an embodiment, the first and second infiltrants may alloy within the single region to comprise a substantially homogenous composition of the first and second infiltrants throughout the single region. In another embodiment, the single region may comprise a gradient including more of the first infiltrant nearer the interfacial surface 109 gradually changing composition to contain more of the second infiltrant nearer working surface 106.

It has been observed that infiltrant disc or foil thickness, notably in a second infiltrant placed on top of a PCD table, may affect first infiltrant infiltration and therefore bonding between a PCD table and a substrate. For example, when a second infiltrant in the form of a 0.005 inch copper disc (having a lower melting temperature than cobalt) was infiltrated from the working surface 106 of a PCD table 102 formed at standard sintering pressures (e.g., at about 5-6 GPa) and leached to contain about 1.2% metal-solvent catalyst or more, the first infiltrant (i.e., cobalt) does not infiltrate as completely as in a PCD table leached more thoroughly. When the second infiltrant disc or foil portion thickness was reduced to about 0.003 inches thick, bonding between the PCD table and the substrate unexpectedly improved and delamination decreased. Limiting the amount of second infiltrant infiltrated into a PCD table, even by a very small amount, such as reduction from 0.005 inches thick foil to 0.003 inches thick foil, reduces the amount of second infiltrant present at the back surface between the PCD table 102 and the substrate 108 sufficiently to allow for more effective bonding therebetween. In such an embodiment, the first infiltrant present in the substrate infiltrates into the PCD table and bonds the PCD table to the substrate more thoroughly upon cooling, while still maintaining some of the second infiltrant therein to improve leaching effectiveness, wear resistance, thermal stability, or combinations thereof. In an embodiment, the amount of second infiltrant may be adjusted to affect the amount of first infiltrant infiltrated into the PCD table during HPHT bonding (i.e., the second HPHT process). For example, a second infiltrant foil, disc, or powder (e.g., powder of about 0.002 inches thick or of a selected amount/weight) may be infiltrated from the working surface 106 to improve wear resistance and thermal stability, while improving bonding between a PDC table 102 and a substrate 108 by infiltration from the interfacial surface 109 and cooling of the first infiltrant during a second HPHT process. The first and second infiltrant compositions and amounts may be tailored to provide the desired balance of improved wear resistance, thermal stability, leaching efficiency, and/or bond strength.

While second infiltrant sources have been described above as being in the form of a disc or a foil, in embodiments, such second infiltrant sources may also comprise a plurality of discs, or foils, or a powder mixture. For example, a mixture of second infiltrant components may be infiltrated by placing a first foil having a second infiltrant component therein on top of the at least partially leached PCD table 150" and a second foil having another second infiltrant component therein on top of the first foil before the second HPHT process. During the second HPHT process the first and second foils will melt and the mixture of second infiltrant components mix and infiltrate into the interstitial pores of the at least partially leached PCD table 150". In an embodiment, a first foil may comprise copper, and a second foil may comprise aluminum, wherein upon application of elevated temperature and elevated pressure conditions of the second HPHT process, a region of the resulting infiltrated PCD table comprises a copper-aluminum mixture. In embodiments, the first and second foils may exhibit individual thicknesses cumulatively comparable to any of the overall thicknesses of the single foils or discs described above. For example, a copper foil may exhibit a thickness of about 0.002 inches and an aluminum foil may exhibit a thickness of about 0.001 inches, totaling a thickness of about 0.003 inches. In another example, a copper foil may exhibit a thickness of about 0.003 inches and an aluminum foil may exhibit a thickness of about 0.002 inches, totaling a thickness of about 0.005 inches. In embodiments, a similar process may be employed using foils, discs, powder mixtures and/or layers, or combinations of the foregoing. In embodiments, any of the second infiltrants described herein may be provided as described above.

The following working examples provide further detail in connection with the specific PDC embodiments described above.

Working Example 1

Three PDCs were formed according to the following process. A layer of diamond particles was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a cell pressure of about 7.0-7.7 GPa for about 220 seconds of soak time (about 370 seconds total process time) at the about 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was subsequently leached to remove substantially all of the cobalt from the interstitial regions between the diamond grains within the PCD table. The leached PCD table was then placed adjacent to a second tungsten carbide substrate (87 weight percent tungsten carbide cemented with 13 weight percent cobalt), with a nickel-silicon-boron disc (having a composition as disclosed hereinabove according to one embodiment) and a copper disc disposed therebetween. The PCD table, the second cemented tungsten carbide substrate, and the copper and Ni—Si—B discs were positioned within a cell assembly, and HPHT processed at a temperature of about 1400° C. and a cell pressure of about 5 GPa in a high-pressure cubic press to attach the PCD table to the second tungsten carbide substrate. The reattached PCD table was then leached over a period of 6 days in hydrofluoric acid to substantially remove the copper, cobalt, and nickel-silicon-boron alloy infiltrants from a region of the PCD table. Leaching removed the copper, cobalt, and nickel-silicon-boron alloy infiltrants from the interstitial regions between diamond grains from the surfaces of the PCD table exposed to the acid to a depth of about 600 μm.

Working Example 2

Three PDCs were formed according to the following process. A layer of diamond particles was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a cell pressure of about 7.0-7.7 GPa for about 220 seconds of soak time (about 370 seconds total process time) at the about 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was subsequently leached to remove substantially all of the cobalt from the interstitial regions between the diamond grains within the PCD table. The leached PCD table was then placed adjacent to a tungsten carbide substrate comprising about 1 weight percent chromium carbide and about 86 weight percent tungsten carbide cemented together with about 13 weight percent cobalt, with a nickel-silicon-boron disc (having a composition as disclosed hereinabove according to one embodiment) and a copper disc disposed therebetween. The PCD table, the chromium cemented tungsten carbide substrate, and the copper and Ni—Si—B discs were positioned within a pyrophyllite cube, and HPHT processed at a temperature of about 1400° C. and a cell pressure of about 5 GPa in a high-pressure cubic press to attach the PCD table to the second tungsten carbide substrate. The reattached PCD table was then leached in hydrofluoric acid as performed in Working Example 1 to substantially remove the copper, cobalt, and nickel-silicon-boron alloy infiltrants from a region of the PCD table. Leaching removed the copper, cobalt, and nickel-silicon-boron alloy infiltrants from the interstitial regions between diamond grains from the surfaces of the PCD table exposed to the acid to a depth of about 200 μm to about 600 μm.

Working Example 3

Figure 4A:
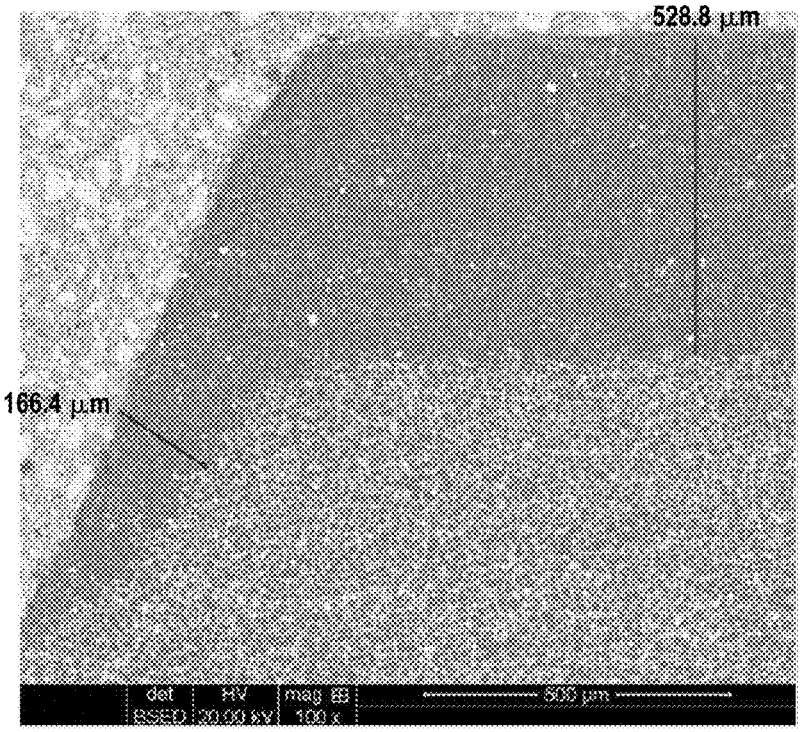
FIGS. 4A-4C are scanning electron microscope ("SEM") photomicrographs of a PDC formed according to Working Example 3 of the invention.
Figure 4B:
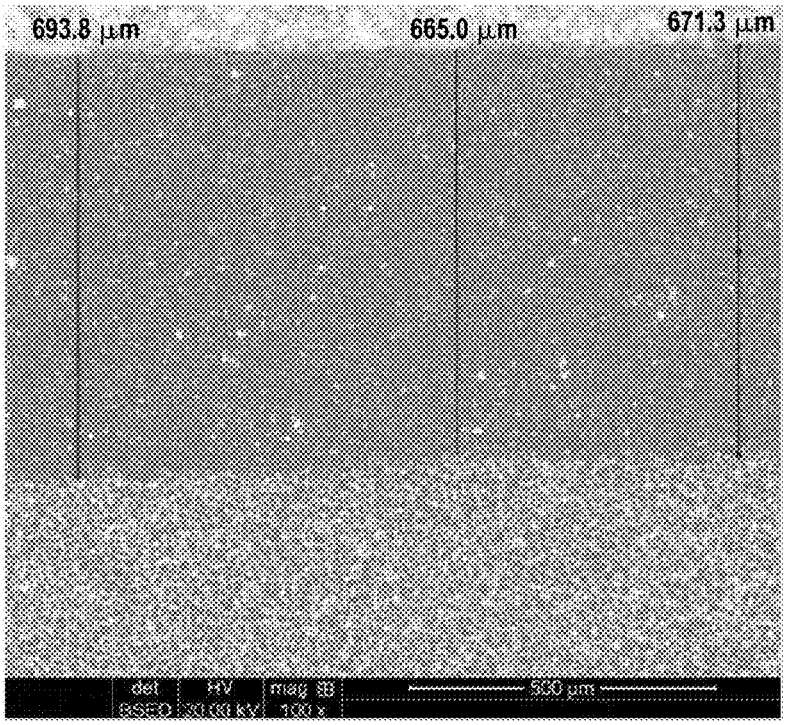
Figure 4C:
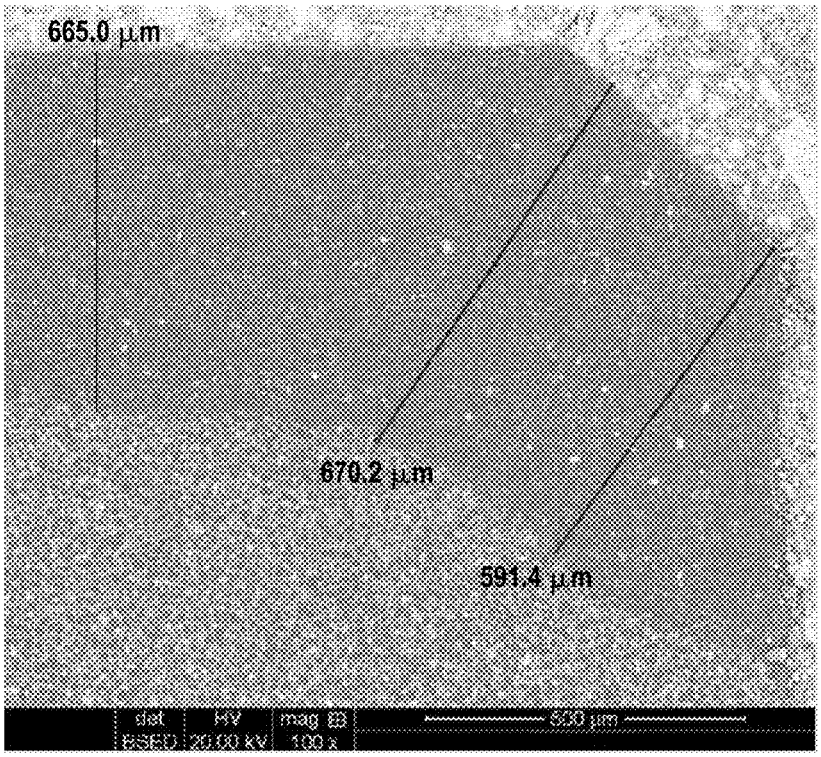

Three PDCs were formed according to the following process. A layer of diamond particles was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a cell pressure of about 7.0-7.7 GPa for about 220 seconds of soak time (about 370 seconds total process time) at the about 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was subsequently leached to remove substantially all of the cobalt from the interstitial regions between the diamond grains within the PCD table. The leached PCD table was then placed adjacent to a second tungsten carbide substrate (87 weight percent tungsten carbide cemented with 13 weight percent cobalt), with a nickel-silicon-boron disc (having a composition as disclosed hereinabove according to one embodiment) disposed therebetween and a copper disc disposed above the PCD table. The PCD table, the second cemented tungsten carbide substrate, and the copper and Ni—Si—B discs were positioned within a cell assembly, and HPHT processed at a temperature of about 1400° C. and a cell pressure of about 5 GPa in a high-pressure cubic press to attach the PCD table to the second tungsten carbide substrate. The reattached PCD table was then leached in hydrofluoric acid as performed in Working Example 1 to substantially remove the copper, cobalt, and nickel-silicon-boron alloy infiltrants from a region of the PCD table. Leaching removed the copper, cobalt, and nickel-silicon-boron alloy infiltrants from the interstitial regions between diamond grains from the surfaces of the PCD table exposed to the acid to a depth of about 600 μm. FIGS. 4A-4C show SEM photomicrographs of the leached PCD table.

Working Example 4

Three PDCs were formed according to the following process. A layer of diamond particles was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a cell pressure of about 7.0-7.7 GPa for about 220 seconds of soak time (about 370 seconds total process time) at the about 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was subsequently leached to remove substantially all of the cobalt from the interstitial regions between the diamond grains within the PCD table. The leached PCD table was then placed adjacent to a tungsten carbide substrate comprising about 1 weight percent chromium carbide and about 86 weight percent tungsten carbide cemented together with about 13 weight percent cobalt, with a nickel-silicon-boron disc (as disclosed hereinabove according to one embodiment) disposed therebetween and a copper disc disposed above the PCD table. The PCD table, the chromium cemented tungsten carbide substrate, and the copper and Ni—Si—B discs were positioned within a cell assembly, and HPHT processed at a temperature of about 1400° C. and a cell pressure of about 5 GPa in a high-pressure cubic press to attach the PCD table to the second tungsten carbide substrate. The reattached PCD table was then leached in hydrofluoric acid as performed in Working Example 1 to substantially remove the copper, cobalt, and nickel-silicon-boron alloy infiltrants from a region of the PCD table. Leaching removed the copper, cobalt, and nickel-silicon-boron alloy infiltrants from the interstitial regions between diamond grains from the surfaces of the PCD table exposed to the acid to a depth of about 200 μm to about 600 μm.

Wear Resistance of Working Examples 1-4

Figure 5A:
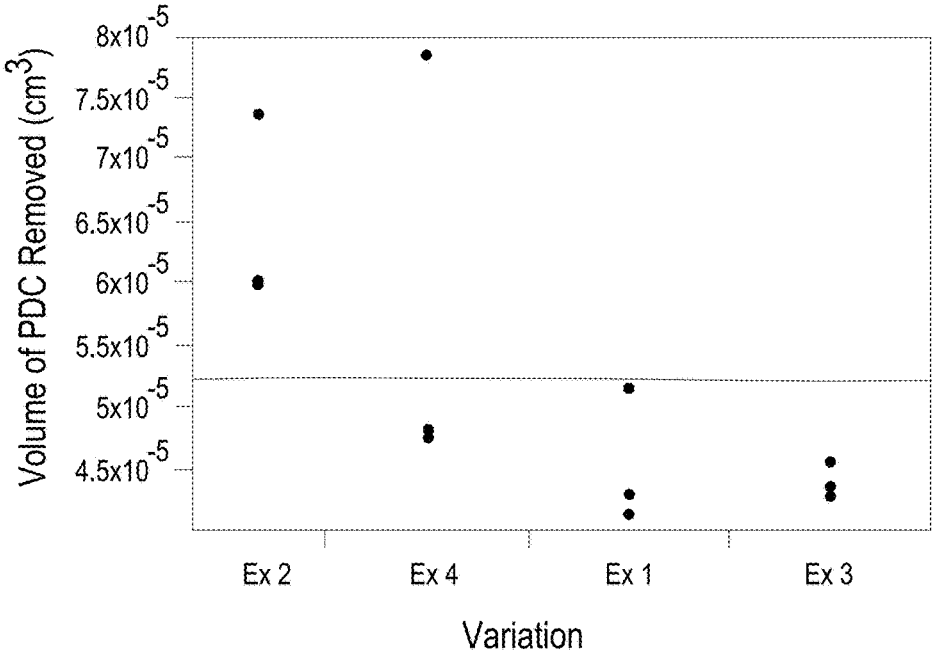
FIG. 5A is a graph of vertical turret lathe wear resistance test data for several PDCs according to working examples of the invention.

The wear resistance of PDCs formed according to Working Examples 1-4 was evaluated as compared to conventional PDCs leached to a depth of about 300 μm. On a wet vertical turret lathe ("VTL") test with water used as coolant, all of Working Examples 1-4 performed equal to or better than the conventional PDC. The wear resistance was evaluated by measuring the volume of PDC removed, while the workpiece was cooled with water. The test parameters were a depth of cut for the PDC of about 0.254 mm, a back rake angle for the PDC of about 20 degrees, an in-feed for the PDC of about 6.35 mm/rev, and a rotary speed of the workpiece to be cut of about 101 RPM. In addition, the relative wear resistance of PDCs formed according to Working Examples 1-4 was compared by measuring the volume of the PDC removed during vertical turret lathe testing after 200 passes. The results are shown in FIG. 5A.

In order to better understand the distribution of infiltrants within the PCD table, EDAX measurements were taken of the PDCs of Working Examples 1 and 3. Measurements were taken near the interface between the PCD table and the substrate (bottom), near a mid-point of the PCD table (middle), and at the top surface of the PCD table (top). These three measurements were taken on the left, at the middle, and right sides of the PCD table. The results are shown in Tables 2A and 2B, below.

TABLE 2A

EDAX Measurements of Working Example 1

| Location | C | O | Co | Ni | Cu | W |
|---|---|---|---|---|---|---|
| Bottom Left | 86.01 | 2.5 | 3.32 | 2.78 | 3.85 | 1.54 |
| Middle Left | 85.84 | 2.66 | 2.29 | 1.99 | 5.88 | 1.33 |
| Top Left | 86.39 | 2.66 | 2.07 | 1.29 | 6.19 | 1.41 |
| Bottom Middle | 85 | 2.42 | 2.58 | 1.78 | 6.67 | 1.54 |
| Middle Middle | 85.36 | 2.77 | 2.02 | 2.9 | 5.78 | 1.17 |
| Top Middle | 85.83 | 3.02 | 1.8 | 1.6 | 6.45 | 1.3 |
| Bottom Right | 86.59 | 2.8 | 2.51 | 1.26 | 5.24 | 1.6 |
| Middle Right | 86.66 | 3.14 | 2.23 | 1.32 | 5.31 | 1.34 |
| Top Right | 86.49 | 3.01 | 2.16 | 0.94 | 6.08 | 1.31 |

TABLE 2B

EDAX Measurements of Working Example 3

| Location | C | O | Co | Ni | Cu | W |
|---|---|---|---|---|---|---|
| Bottom Left | 86.65 | 2.59 | 4.48 | 2.81 | 1.97 | 1.5 |
| Middle Left | 87 | 2.97 | 2.46 | 1.05 | 5.21 | 1.32 |
| Top Left | 86.58 | 2.69 | 2.28 | 0.86 | 6.12 | 1.46 |
| Bottom Middle | 85.07 | 2.82 | 2.1 | 1.65 | 6.74 | 1.62 |
| Middle Middle | 86.11 | 2.46 | 1.88 | 0.88 | 7.13 | 1.53 |
| Top Middle | 86.17 | 2.9 | 2.04 | 0.67 | 6.6 | 1.62 |
| Bottom Right | 87.45 | 2.69 | 2.73 | 3.97 | 1.77 | 1.39 |
| Middle Right | 87.26 | 2.63 | 2.24 | 1.15 | 5.47 | 1.25 |
| Top Right | 86.82 | 3.02 | 2.14 | 0.82 | 5.83 | 1.37 |

From the EDAX readings, it is apparent that when the copper foil is placed on top of the PCD table and the NiBSi foil is placed between the tungsten carbide substrate and the PCD table there is a steeper gradient of copper in the PCD table with more copper near the top. The gradient went from about 3.5% copper near the interface to about 6.18% copper near the top of the PCD table. When both NiBSi and copper foils were placed between the tungsten carbide and PCD table the copper fraction at the interface is 5.25% and 6.24% at the top of the diamond table. In both samples, it is apparent that the cobalt and/or nickel, (from the first infiltrant) and copper (the second infiltrant) are alloying throughout the PCD table. In an embodiment, the copper or other second infiltrant source may be positioned on top of the PCD table with the first infiltrant source positioned below the PCD table to reduce copper (or other second infiltrant) concentration at the interface and increase copper (or other second infiltrant) concentration at the top of the PCD table, such as less than about 3% by weight, or less than about 2% by weight. This may provide increased bond strength between the substrate and the PCD table by having more Ni and/or Co at the interface, while also providing faster and/or more complete leaching by having more copper (or other second infiltrant) at the top of the PCD table.

Working Example 5

Sixty-four cobalt-silicon alloy infiltrated PDCs were formed according to the following process. A layer of diamond particles was sintered in the presence of cobalt under a first set of HPHT conditions including using about 6 GPa cell pressure to form PCD tables. The resulting PCD tables were leached to substantially remove the cobalt. An about 0.003 inch copper foil was placed on top of each of the sixty four at least partially leached PCD tables prior to bonding each of the at least partially leached PCD tables to a cobalt-cemented tungsten carbide substrate. The at least partially leached PCD tables were bonded to a cobalt-cemented tungsten carbide substrate comprising a cobalt-silicon alloy including about 0.5% by weight silicon (i.e., about 3.5% weight of the cobalt-silicon alloy first infiltrant) all under second HPHT conditions, including about 5 GPa cell pressure. During the second HPHT process, the copper was infiltrated into the PCD tables from an upper surface thereof, and the cobalt-silicon alloy was infiltrated into the PCD tables from an interfacial surface of the cobalt-cemented tungsten carbide substrate. The resulting PDCs were then chamfered to produce an about 0.012 inch peripherally extending edge chamfer around the upper surface of the PCD tables. Thirty reattached PDCs were segregated for testing (without a second leaching), and the remaining thirty-four PDCs were leached in hydrofluoric acid for 56 hours at 75° C. Similar manufacturing processes were followed with a control group of PDCs (noted as "Compact 1" in FIGS. 5C-5E), except the first infiltrant was pure cobalt.

Thirty unleached PDCs were subjected to durability and braze testing. Thirty-four leached PDCs were subjected to face load durability testing, and vertical turret lathe ("VTL") testing.

Durability, VTL, and Braze Test Results for Working Example 5

Figure 5B:
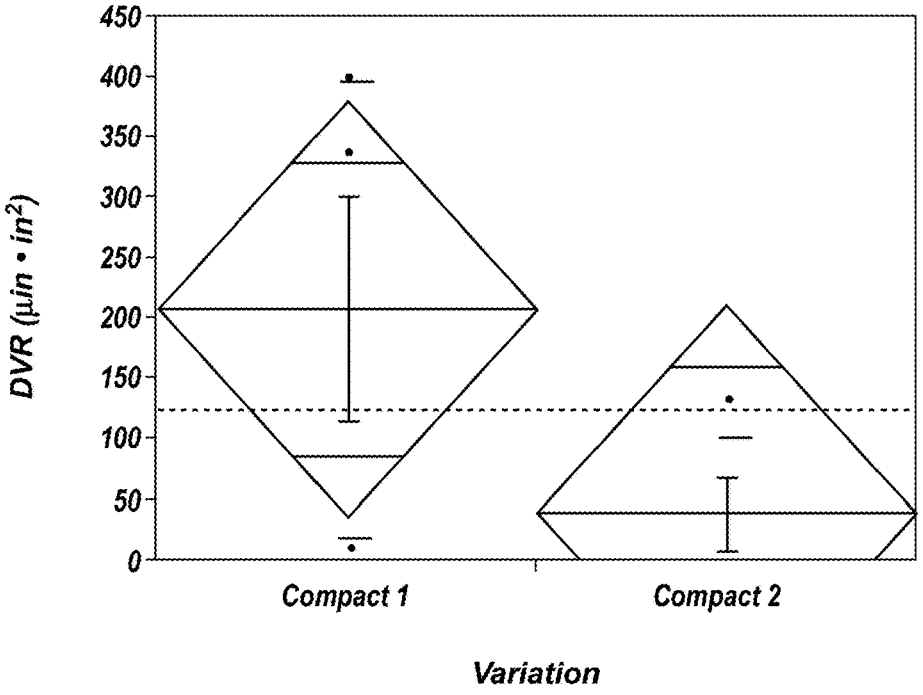
FIG. 5B is a graph of wear resistance test data for PDCs according to working examples of the invention.

On a wet VTL test substantially as described above, four of the leached, copper and cobalt-silicon alloy infiltrated PDCs from Working Example 5, listed as Compact 2 in FIG. 5B, performed at least equal to Compact 1. Ten of the unleached copper and cobalt-silicon infiltrated PDCs were tested by brazing the PDCs to another structure. None of the braze-tested PDCs exhibited cracking after brazing. Ten of the leached and copper and cobalt-silicon alloy infiltrated PDCs were subjected to VTL testing.

FIG. 5B illustrates wear test data that demonstrated that cobalt-silicon infiltrated PDC (denoted by "Compact 2") exhibited significantly better wear resistance than that of Compact 1 in a VTL test as described above. As shown in FIG. 5B, Compact 2 exhibited significantly less diamond volume removed ("DVR") than Compact 1 during the VTL test.

Figure 5C:
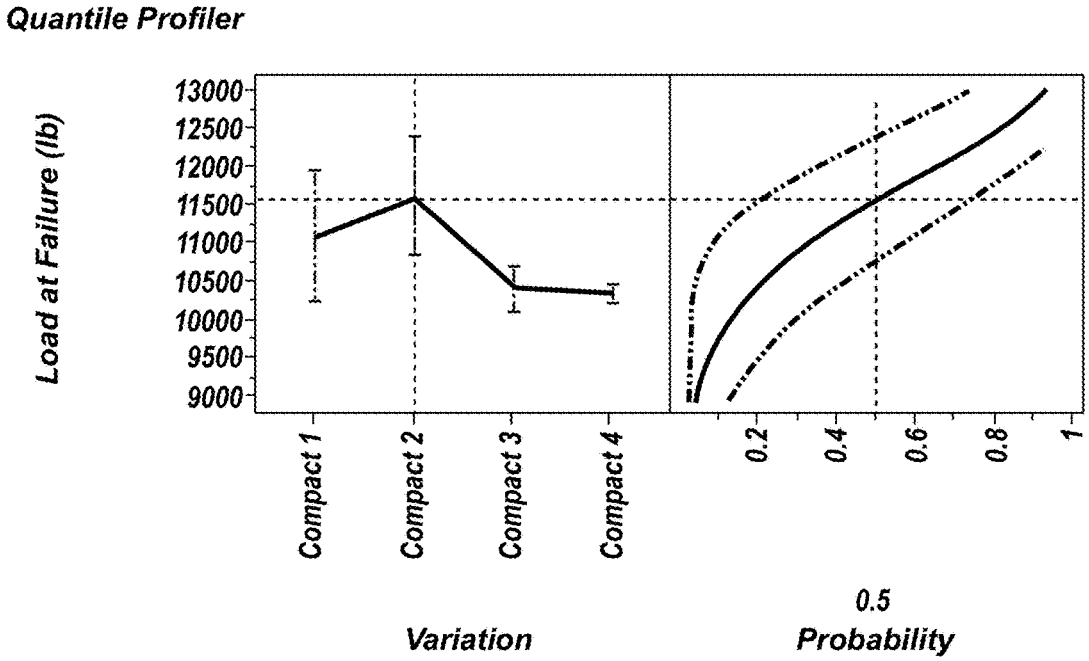
FIG. 5C is a graph of relative durability (load at failure) test data for PDCs according to working examples of the invention.

FIG. 5C illustrate strength testing of twenty of each of the leached and unleached copper and cobalt-silicon alloy infiltrated PDCs. The results of the strength testing are shown in FIG. 5C. The strength testing was carried out by face loading opposing PDCs while observing and/or recording pressures and/or breakage. Face loading was carried out in a fixture under a compressive load in which the face of a PDC is opposed to the face of a like PDC and the movement of the PDC elements is constrained to the axis of loading. A load is applied (e.g., a steady load or a ramping load) until at least a single PDC completely fails (i.e., the PCD table cracks and/or breaks away from the substrate). Relative strength was determined using, in part, the load at complete failure of the PDC.

FIG. 5C is a graph of the average load at failure of compacts 1-4, including the statistical average probability of failure at a given load and the upper and lower bounds of the average range of probability of failure at a given load. Notably, as shown in FIG. 5C, the cobalt-silicon alloy infiltrated PDCs, Compact 2, had an average load at failure at least about 500 pounds higher than Compact 1, Compact 3, and Compact 4.

Working Example 6

PDCs were formed according to the following process. A layer of diamond particles was sintered in the presence of cobalt under a first set of HPHT conditions including using about 6 GPa cell pressure. The resulting PCD tables were leached in a mixture of nitric and hydrofluoric acids for about 24 days. A copper foil and an aluminum foil were positioned on top (i.e., at the working surface) of each of the at least partially leached PCD tables prior to bonding each of the PCD tables to a substrate. The at least partially leached PCD tables were bonded to a cemented tungsten-carbide substrate comprising a cobalt-silicon alloy including about 0.5% by weight silicon (i.e., about 3.5% weight of the cobalt-silicon alloy first infiltrant) all under second HPHT conditions, including about 5 GPa cell pressure. During the second HPHT process, the copper and aluminum were infiltrated into the at least partially leached PCD tables from an upper surface thereof, and the cobalt-silicon alloy was infiltrated into the PCD tables from the interfacial surface of the substrate. The resulting PDCs were then chamfered to produce a 0.012 inch peripherally extending edge chamfer around the upper surface of the PCD tables. After reattachment, the PCD tables were not leached a second time.

Thermal Stability and VTL Test Results for Working Example 6

Thermal stability testing was performed on the PDCs of Working Example 6 using a mill test. The thermal stability was evaluated in a mill test in which a PDC is used to cut a Barre granite workpiece. The test parameters used were an in-feed for the PDC of about 50.8 cm/min, a width of cut for the PDC of about 7.62 cm, a depth of cut for the PDC of about 0.762 mm, a rotary speed of the workpiece to be cut of about 300 RPM, and an indexing in the Y direction across the workpiece of about 7.62 cm.

Figure 5D:
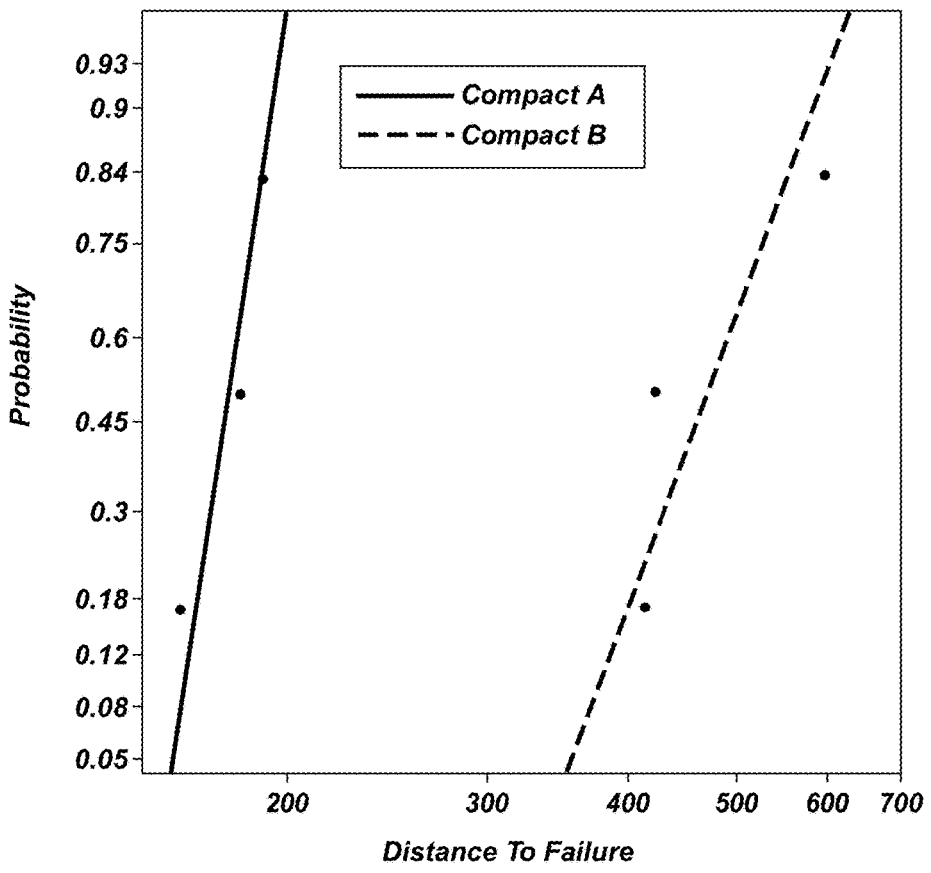
FIG. 5D is a graph of probability of failure versus distance to failure of the PDCs according to working examples of the invention.

FIG. 5D is a graph of probability to failure of a PDC versus distance to failure for the PDC from the mill tested PDCs. FIG. 5D demonstrated that the PDC of Working Example 6 (denoted by "Compact B") exhibited exceptional thermal stability compared to a conventional PDC (denoted by "Compact A") comprising an unleached PCD formed at about 6 GPa cell pressure on a standard cobalt-cemented tungsten carbide substrate and containing no silicon. The data points corresponding to the conventional PDC demonstrated that such PDCs exhibited a lower distance to failure for a given probability of failure demonstrating that the PDCs of Working Example 6 exhibited greater thermal stability.

Figure 5E:
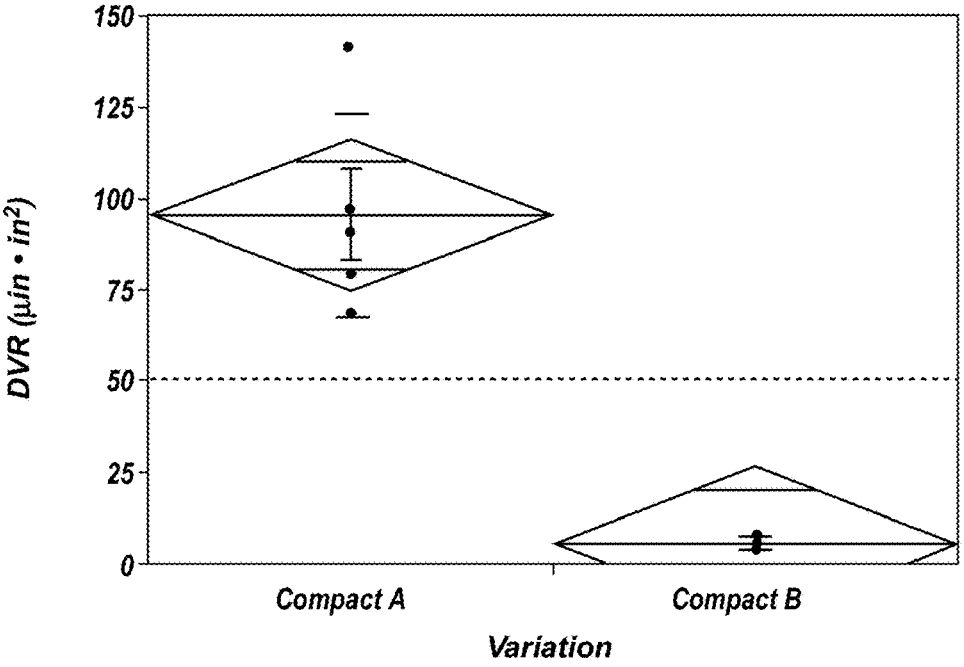
FIG. 5E is a graph of wear resistance test data for PDCs according to working examples working examples of the invention.
Figure 5F:
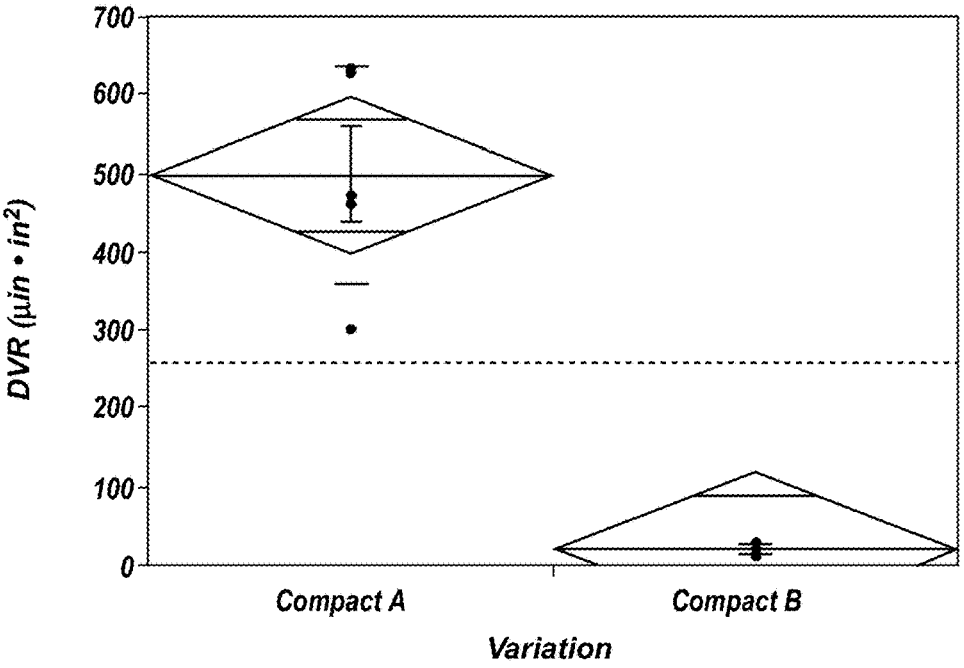
FIG. 5F is a graph of wear resistance test data for PDCs according to working examples working examples of the invention.
Figure 5G:
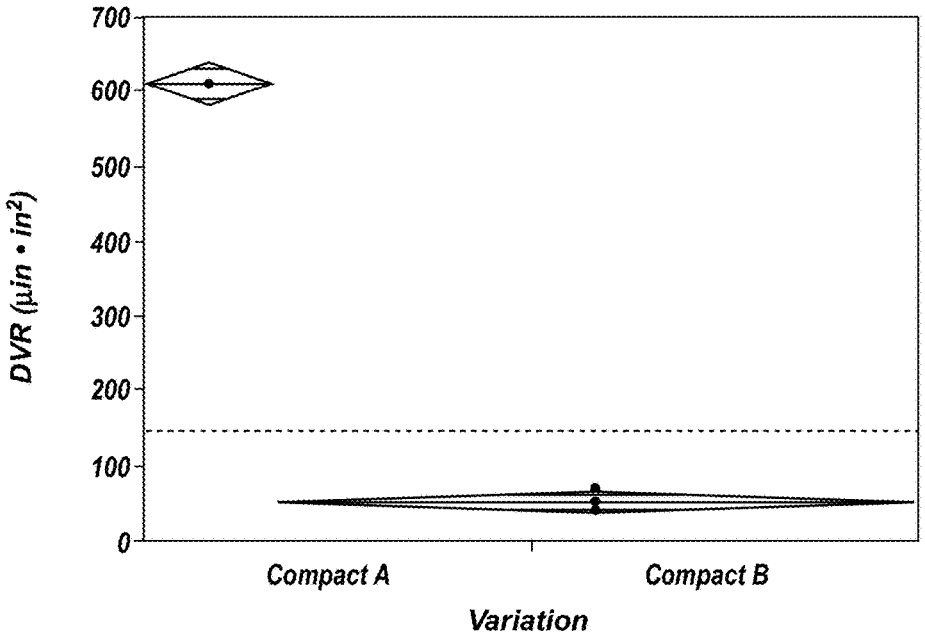
FIG. 5G is a graph of wear resistance test data for PDCs according to working examples working examples of the invention.

As shown in FIGS. 5E-5G, in a wet VTL test substantially as described above, Working Example 6 also performed significantly better than the conventional PDC of Compact A. As shown in FIGS. 5E-5G, the relative wear resistance of PDCs formed according to Working Example 6 exhibited substantially less DVR during vertical turret lathe testing after 50, 100, and 150 passes as shown in FIGS. 5E-5G, respectively.

The PDCs formed according to the various embodiments disclosed herein may be used as PDC cutting elements on a rotary drill bit. For example, in a method according to an embodiment of the invention, one or more PDCs may be received that were fabricated according to any of the disclosed manufacturing methods and attached to a bit body of a rotary drill bit.

Figure 6:
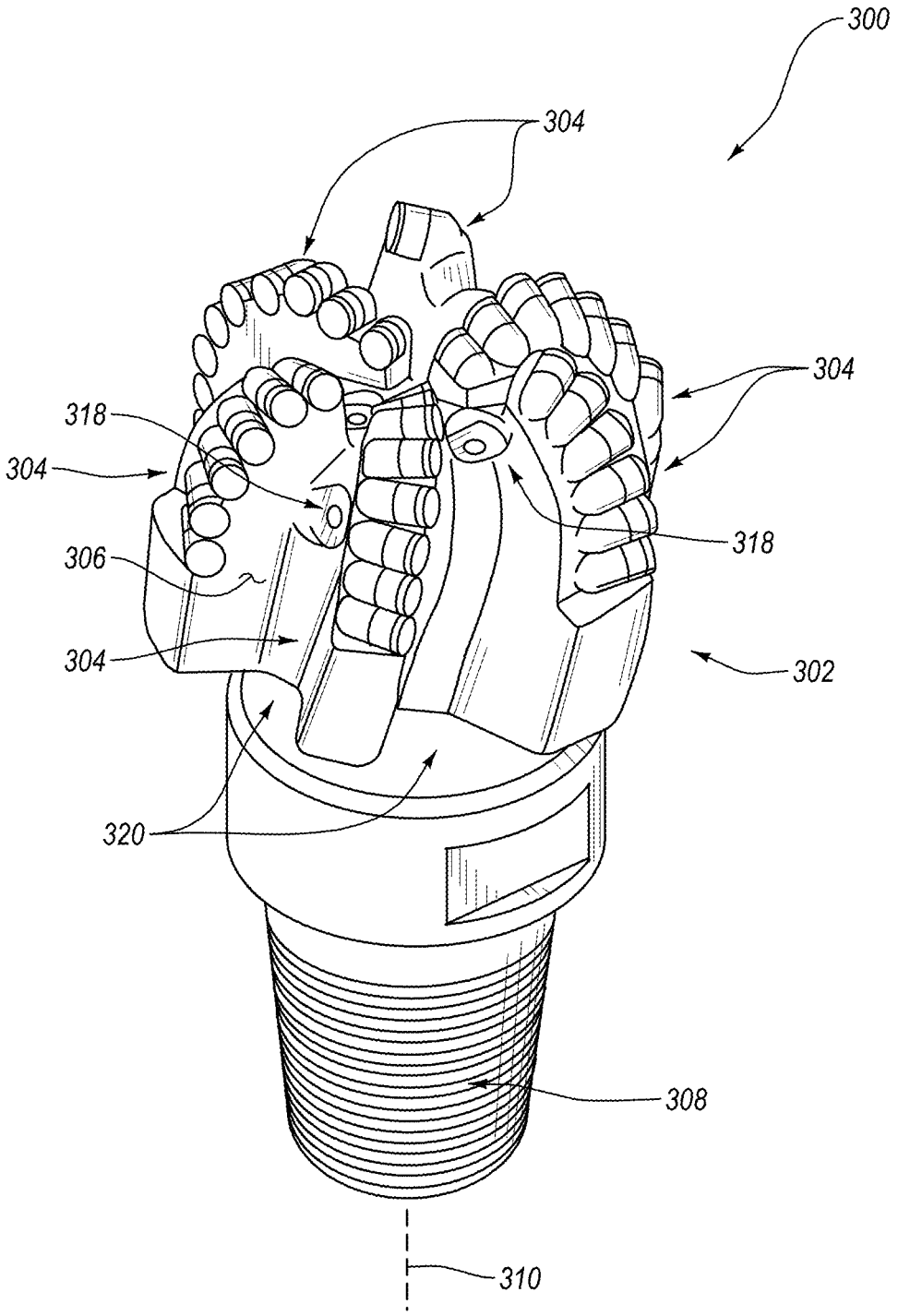
FIG. 6 is an isometric view of an embodiment of a rotary drill bit that may employ one or more of the disclosed PDC embodiments as cutting elements.
Figure 7:
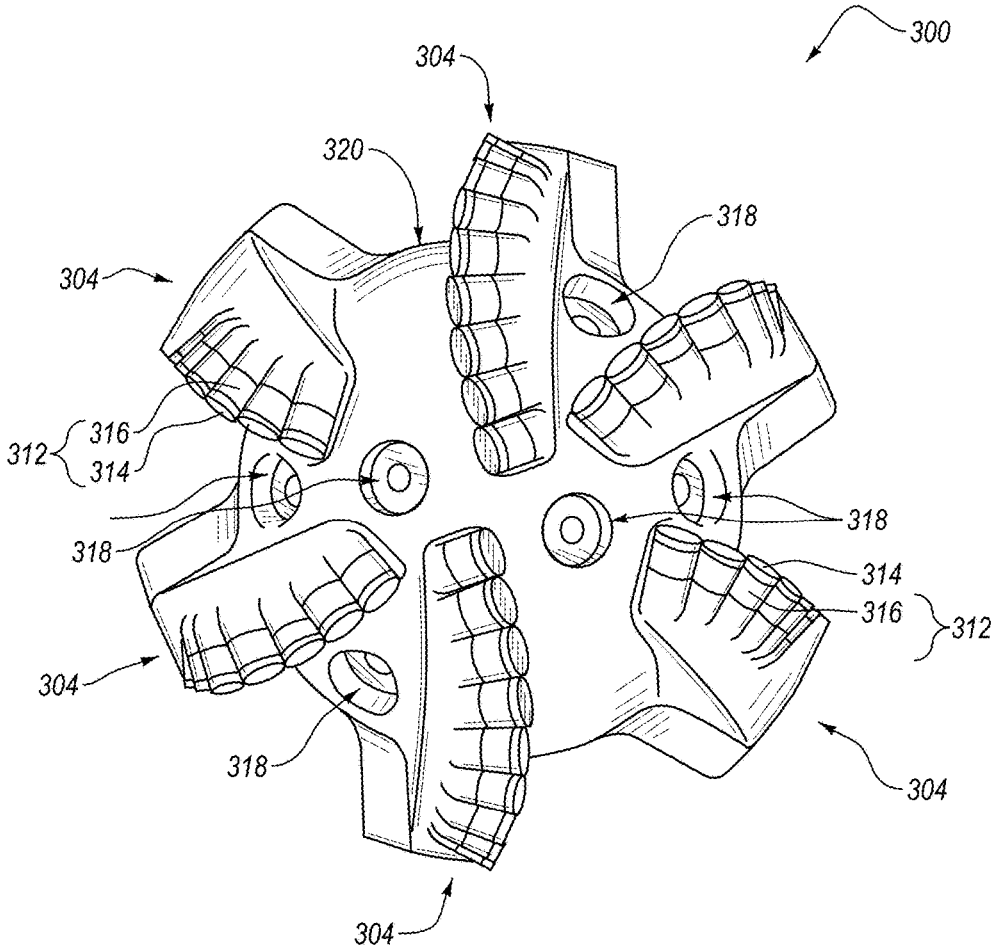
FIG. 7 is a top elevation view of the rotary drill bit shown in FIG. 6.

FIG. 6 is an isometric view and FIG. 7 is a top elevation view of an embodiment of a rotary drill bit 300 that includes at least one PDC configured and/or fabricated according to any of the disclosed PDC embodiments. The rotary drill bit 300 comprises a bit body 302 that includes radially-extending and longitudinally-extending blades 304 having leading faces 306, and a threaded pin connection 308 for connecting the bit body 302 to a drilling string. The bit body 302 defines a leading end structure for drilling into a subterranean formation by rotation about a longitudinal axis 310 and application of weight-on-bit. At least one PCD cutting element 312, configured according to any of the previously described PDC embodiments, may be affixed to the bit body 302. With reference to FIG. 7, each of a plurality of PCD cutting elements 312 is secured to the blades 304 of the bit body 302 (FIG. 6). For example, each PCD cutting element 312 may include a PCD table 314 bonded to a substrate 316. More generally, the PCD cutting elements 312 may comprise any PDC disclosed herein, without limitation. In addition, if desired, in some embodiments, a number of the PCD cutting elements 312 may be conventional in construction. Also, circumferentially adjacent blades 304 define so-called junk slots 320 therebetween. Additionally, the rotary drill bit 300 includes a plurality of nozzle cavities 318 for communicating drilling fluid from the interior of the rotary drill bit 300 to the PDCs 312.

FIGS. 6 and 7 merely depict one embodiment of a rotary drill bit that employs at least one PDC fabricated and structured in accordance with the disclosed embodiments, without limitation. The rotary drill bit 300 is used to represent any number of earth-boring tools or drilling tools, including, for example, core bits, roller-cone bits, fixed-cutter bits, eccentric bits, bi-center bits, reamers, reamer wings, or any other downhole tool including superabrasive compacts, without limitation.

The PDCs disclosed herein (e.g., PDC 100 of FIG. 1A) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIG. 1A) configured according to any of the embodiments disclosed herein and may be operably assembled to a downhole drilling assembly. U.S. Pat. Nos. 4,410,054; 4,560,014; 5,364,192; 5,368,398; 5,480,233; 7,552,782; and 7,559,695, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A method of fabricating a polycrystalline diamond compact, comprising:

forming a polycrystalline diamond table by sintering a plurality of diamond particles together in the presence of a metal-solvent catalyst in a first high-pressure/high-temperature process including a cell pressure of about 7.5 GPa to about 9 GPa, the polycrystalline diamond table including a plurality of bonded diamond grains defining a plurality of interstitial regions, at least a portion of the plurality of interstitial regions including the metal-solvent catalyst therein;

at least partially leaching the polycrystalline diamond table to remove at least a portion of the metal-solvent catalyst therefrom to form an at least partially leached polycrystalline diamond table;

attaching the at least partially leached polycrystalline diamond table to a cemented carbide substrate by subjecting the at least partially leached polycrystalline diamond table and the cemented carbide substrate having a first infiltrant therein to a second high-pressure/high-temperature process under diamond-stable temperature-pressure conditions effective to at least partially infiltrate the at least partially leached polycrystalline diamond table with the first infiltrant inward from a back surface bonded to an interfacial surface on the substrate, the first infiltrant including a cobalt alloy or a nickel alloy having about 1 wt % to about 4 wt % of at least one eutectic forming alloying constituent by weight, wherein the at least one eutectic forming alloying constituent is selected from the group consisting of silicon, boron, phosphorous, tantalum, and carbides thereof, wherein the at least one eutectic forming alloying constituent is present in a hypo-eutectic amount or a hyper-eutectic amount; and infiltrating the at least partially leached polycrystalline diamond table with a second infiltrant inward from an upper surface thereof, the second infiltrant including copper.

2. The method of claim 1 wherein attaching the polycrystalline diamond table to the substrate and infiltrating the polycrystalline diamond table with a second infiltrant are performed substantially simultaneously during the second high-pressure/high-temperature process.

3. The method of claim 1 wherein the first infiltrant in the cemented carbide substrate is a cementing constituent of the cemented carbide substrate.

4. The method of claim 1 wherein the second infiltrant further includes aluminum.

5. The method of claim 1 wherein the first and second infiltrants form an alloy that is interstitially disposed within the infiltrated polycrystalline diamond table, the alloy exhibiting a composition that varies through a thickness of the infiltrated polycrystalline diamond table.

6. The method of claim 5 wherein the alloy is disposed in a single region therein, the single region including a gradient in which the first infiltrant is present in a larger proportion in the alloy nearer the interfacial surface and the second infiltrant is present in a larger proportion in the in the alloy nearer the working surface.

7. The method of claim 1 wherein the first infiltrant is interstitially disposed at least partially within at least a first region extending inwardly from the interfacial surface and the second infiltrant is interstitially disposed at least partially within at least a second region extending inwardly from the working surface of the at least partially leached polycrystalline diamond table towards the interfacial surface.

8. The method of claim 1 wherein infiltrating the at least partially leached polycrystalline diamond table with a second infiltrant includes positioning at least one of a disc or foil containing a component of the second infiltrant on the upper surface of the at least partially leached PCD table prior to the second high pressure/high temperature process.

9. The method of claim 7 wherein a third region extends between the first region and the second region.

10. The method of claim 9 wherein the third region comprises an alloy of the first infiltrant and the second infiltrant, the alloy forming a gradient wherein the first infiltrant is present in a larger proportion nearer the interfacial surface and the second infiltrant is present in a larger proportion nearer the working surface.

11. The method of claim 8, further comprising leaching at least one of the first infiltrant or the second infiltrant from the polycrystalline diamond table.

12. The method of claim 8 wherein the disc or foil is 0.003 inches thick or less.

13. The method of claim 12 wherein the second infiltrant includes aluminum.

14. The method of claim 1 wherein the at least one eutectic forming alloying constituent is present in an amount effective to reduce a melting temperature of the cobalt-silicon alloy under standard pressure conditions to about 1300° C. or less.

15. The method of claim 1, further comprising leaching the infiltrated polycrystalline diamond table to form a region extending inwardly from the upper working surface thereof that is substantially free of at least one of the first infiltrant or the second infiltrant.

16. A method of fabricating a polycrystalline diamond compact, comprising:

forming a polycrystalline diamond table by sintering a plurality of diamond particles together in the presence of a metal-solvent catalyst in a first high-pressure/high-temperature process including a cell pressure of at least about 5 GPa, the polycrystalline diamond table including a plurality of bonded diamond grains defining a plurality of interstitial regions, at least a portion of the plurality of interstitial regions including the metal-solvent catalyst therein;

at least partially leaching the polycrystalline diamond table to remove at least a portion of the metal-solvent catalyst therefrom to form an at least partially leached polycrystalline diamond table;

attaching the at least partially leached polycrystalline diamond table to a cemented carbide substrate by subjecting the at least partially leached polycrystalline diamond table and the cemented carbide substrate having a first infiltrant therein to a second high-pressure/high-temperature process under diamond-stable temperature-pressure conditions effective to at least partially infiltrate the at least partially leached polycrystalline diamond table with the first infiltrant inward from a back surface bonded to an interfacial surface on the substrate, the first infiltrant including a cobalt alloy or a nickel alloy having about 1 wt % to about 4 wt % of at least one eutectic forming alloying constituent by weight, wherein the at least one eutectic forming alloying constituent is selected from the group consisting of silicon, boron, phosphorous, tantalum, and carbides thereof, wherein the at least one eutectic forming alloying constituent is present in a hypo-eutectic amount or a hyper-eutectic amount; and infiltrating the at least partially leached polycrystalline diamond table with a second infiltrant inward from an upper surface thereof, the second infiltrant including copper.

* * * * *